US009863155B2

(12) United States Patent
Cerny et al.

(10) Patent No.: US 9,863,155 B2
(45) Date of Patent: Jan. 9, 2018

(54) SYNTHETIC FLOORING APPARATUS

(71) Applicant: Connor Sport Court International, LLC, Salt Lake City, UT (US)

(72) Inventors: Ronald N. Cerny, Park City, UT (US); Michael T. Bradfield, Riverton, UT (US); Ulises H. Espinoza, Murray, UT (US)

(73) Assignee: Connor Sport Court International, LLC, Salt Lake City, UT (US)

( * ) Notice: Subject to any disclaimer, the term of this patent is extended or adjusted under 35 U.S.C. 154(b) by 0 days.

(21) Appl. No.: 15/011,963

(22) Filed: Feb. 1, 2016

(65) Prior Publication Data

US 2016/0222674 A1 Aug. 4, 2016

Related U.S. Application Data

(63) Continuation-in-part of application No. 14/196,830, filed on Mar. 4, 2014, now abandoned.

(51) Int. Cl.

| | |
|---|---|
| ***E04F 15/22*** | (2006.01) |
| ***E04F 15/02*** | (2006.01) |
| ***E04F 15/10*** | (2006.01) |

(52) U.S. Cl.

CPC ..... *E04F 15/225* (2013.01); *E04F 15/02038* (2013.01); *E04F 15/105* (2013.01); *E04F 2201/0146* (2013.01); *E04F 2201/021* (2013.01)

(58) Field of Classification Search

CPC ... E04F 15/02038; E04F 15/105; E04F 15/22; E04F 15/020161; E04F 15/225; E04F 2201/0146; E04F 2201/021; E04F 2201/09; E04F 2201/091; E04F 2201/093; E04F 2201/095; E04F 2201/098; E04F 2201/05; E04F 2201/0505; E04F 2201/0138

See application file for complete search history.

(56) References Cited

U.S. PATENT DOCUMENTS

| | | | |
|---|---|---|---|
| 3,438,312 | A | 4/1969 | Becker et al. |
| 3,909,996 | A | 10/1975 | Ettlinger et al. |

(Continued)

FOREIGN PATENT DOCUMENTS

| | | |
|---|---|---|
| CN | 201991188 U | 9/2011 |
| EP | 0109941 | 5/1984 |
| WO | WO 03/044305 A1 | 5/2003 |

OTHER PUBLICATIONS

Mateflex; Mateflex III; http://web.archive.org/web/20120511132721/http://www.mateflex.com/products/mateflex-iii/ ; May 11, 2012; 2 pages; Mateflex.

(Continued)

*Primary Examiner* — James Ference

(74) *Attorney, Agent, or Firm* — Thorpe North & Western LLP

(57) ABSTRACT

A modular floor tile is disclosed having a top surface. A plurality of edge surfaces defines a perimeter about the top surface and a support system is disposed at least partially beneath the top surface. A locking system allows for flexible displacement of a laterally extending protrusion having a flexible wall while placing a downward facing protrusion therein and/or allows for flexible displacement of the flexible walls of a downward facing protrusion while placing said downward facing protrusion into the laterally extending protrusion.

19 Claims, 20 Drawing Sheets

(56) References Cited

U.S. PATENT DOCUMENTS 4,436,779 A 3/1984 Menconi et al.
4,584,221 A * 4/1986 Kung ..... E01C 13/045 404/36
4,807,412 A * 2/1989 Frederiksen ..... A47G 27/0212 52/177
4,879,857 A 11/1989 Peterson et al.
4,930,286 A 6/1990 Kolter
5,323,575 A 6/1994 Yeh
5,365,710 A 11/1994 Randjelovic
5,492,069 A 2/1996 Alexander et al.
5,509,244 A 4/1996 Bentzon
5,628,160 A 5/1997 Kung
5,682,724 A 11/1997 Randjelovic
5,713,175 A * 2/1998 Mitchell ..... E01C 5/005 108/156
5,787,654 A 8/1998 Drost
5,833,386 A 11/1998 Rosan et al.
5,904,021 A 5/1999 Fisher
5,907,934 A * 6/1999 Austin ..... E04F 15/082 404/34
5,950,378 A 9/1999 Council et al.
5,992,106 A 11/1999 Carling et al.
6,061,979 A 5/2000 Johannes
6,098,354 A 8/2000 Skandis
6,451,400 B1 9/2002 Brock et al.
6,467,224 B1 10/2002 Bertolini
6,802,159 B1 10/2004 Kolter
6,878,430 B2 * 4/2005 Milewski ..... A01K 1/0157 15/215
7,211,314 B2 5/2007 Nevison
7,571,573 B2 * 8/2009 Moller, Jr. ..... E01C 5/20 472/92
7,587,865 B2 * 9/2009 Moller, Jr. ..... E01C 5/20 52/177
7,690,160 B2 * 4/2010 Moller, Jr. ..... E04F 15/10 404/35
7,748,177 B2 * 7/2010 Jenkins ..... E01C 5/20 15/215
7,793,471 B2 * 9/2010 Hill ..... B32B 3/10 428/33
7,900,416 B1 3/2011 Yokubison et al.
7,958,681 B2 * 6/2011 Moller, Jr. ..... E01C 5/20 52/181
8,006,443 B2 * 8/2011 Fuccella ..... E04F 15/10 52/177
8,020,783 B2 9/2011 Backman, Jr.
8,099,915 B2 * 1/2012 Moller, Jr. ..... E01C 5/20 52/177
8,109,050 B2 2/2012 Ovaert
8,128,311 B2 * 3/2012 Son ..... A63C 19/04 403/326
8,341,896 B2 1/2013 Moller, Jr. et al.
8,505,256 B2 * 8/2013 Cerny ..... E04F 15/10 472/92
2002/0189176 A1 12/2002 Stegner et al.
2004/0226242 A1 * 11/2004 Moller, Jr. ..... E04F 15/105 52/384
2004/0244320 A1 12/2004 Kalisiak et al.
2004/0258869 A1 12/2004 Walker
2005/0108968 A1 * 5/2005 Forster ..... E01C 5/20 52/578
2005/0193669 A1 9/2005 Jenkins et al.
2005/0252109 A1 * 11/2005 Fuccella ..... E04F 15/02172 52/177
2006/0070314 A1 4/2006 Jenkins et al.
2006/0272252 A1 12/2006 Moller, Jr.
2006/0283118 A1 12/2006 Moller, Jr.
2006/0283125 A1 12/2006 Moller, Jr.
2006/0285920 A1 12/2006 Gettig et al.
2007/0011980 A1 * 1/2007 Stegner ..... E04F 15/105 52/586.1
2007/0289244 A1 12/2007 Haney et al.
2008/0216437 A1 9/2008 Prevost et al.
2009/0031658 A1 2/2009 Moller et al.
2009/0165414 A1 7/2009 Burk et al.
2009/0235605 A1 9/2009 Haney et al.
2011/0179728 A1 7/2011 Cerny et al.
2011/0185658 A1 8/2011 Cerny et al.
2012/0085043 A1 4/2012 Jenkins et al.
2013/0167458 A1 7/2013 Cerny et al.

OTHER PUBLICATIONS

Mateflex; Our Products, Mateflex III; http://www.mateflex.com/products/mateflex-iii/ ; accessed online Jul. 16, 2013; 4 pages; Mateflex.

* cited by examiner

SYNTHETIC FLOORING APPARATUS

PRIORITY CLAIM

This application is a continuation-in-part of, and claims priority to, U.S. Ser. No. 14/196,830 entitled "Synthetic Flooring Apparatus" filed on Mar. 4, 2014 which is incorporated herein by reference in its entirety.

FIELD OF THE TECHNOLOGY

The present technology relates to synthetic flooring and more particularly to devices and methods for connecting adjacent modular synthetic floor tiles.

BACKGROUND OF THE TECHNOLOGY AND RELATED ART

Suspended flooring and modular floor tiles have been used for numerous years in connection with improved safety, appearance, and function. In recent years, synthetic modular flooring products have been used for these purposes and more frequently used in connection with sporting events. Many of these flooring products, however, offer little to no impact absorbing characteristics resulting in increased fatigue or injury from walking, running, jumping, or other activities on the flooring. Namely, in order to ensure the top surface of the floor is sufficiently firm to provide "ball-bounce" characteristics and provide sufficient friction, synthetic floor tiles are made from a rigid or semi-rigid material which yields very little under normal use.

Attempts have been made to improve the impact absorbing characteristics of synthetic flooring products. Examples include, but are not limited to U.S. Pat. Nos. 7,587,865, 7,748,177, and 8,505,256, but each technology described in those cases contains deficiencies. Moreover, attempts have been made to improve the devices that connect adjacent modular flooring components together but those attempts also contain deficiencies. It is therefore desirable to have a synthetic flooring product with improved impact absorbing characteristics and improved locking devices.

SUMMARY

A modular floor tile is disclosed having a top surface. A plurality of edge surfaces define a perimeter about the top surface and a support system is disposed at least partially beneath the top surface. A locking system allows for flexible displacement of a laterally extending protrusion having a flexible wall while placing a downward facing protrusion therein and/or allows for flexible displacement of the flexible walls of a downward facing protrusion while placing said downward facing protrusion into the laterally extending protrusion.

BRIEF DESCRIPTION OF THE DRAWINGS

The present technology will become more fully apparent from the following description and appended claims, taken in conjunction with the accompanying drawings. Understanding that these drawings merely depict exemplary aspects of the present technology, they are therefore not to be considered limiting of its scope. It will be readily appreciated that the components of the present technology, as generally described and illustrated in the figures herein, could be arranged and designed in a wide variety of different configurations. Nonetheless, the technology will be described and explained with additional specificity and detail through the use of the accompanying drawings in which:

DETAILED DESCRIPTION

Figure 1:
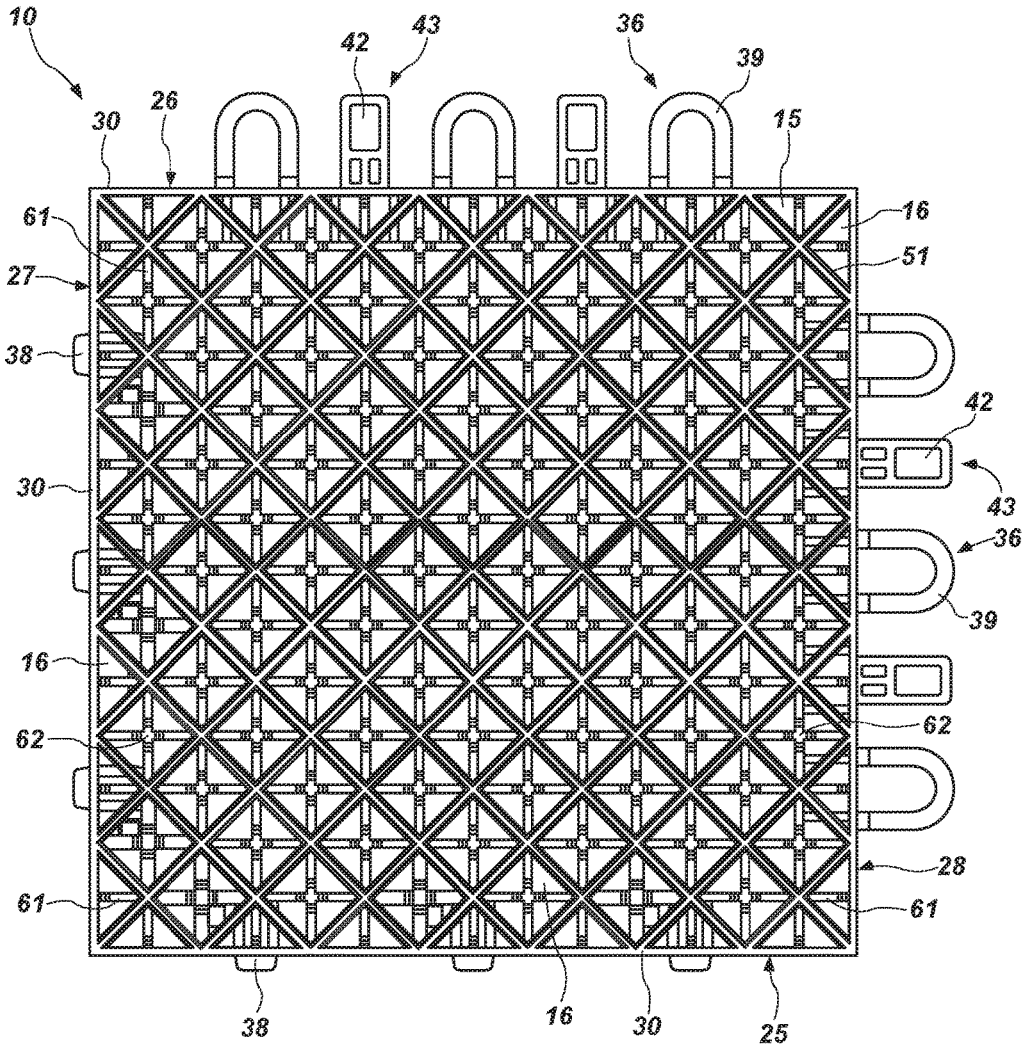
FIG. 1 is a top view of a synthetic modular floor tile in accordance with one aspect of the technology.
Figure 2:
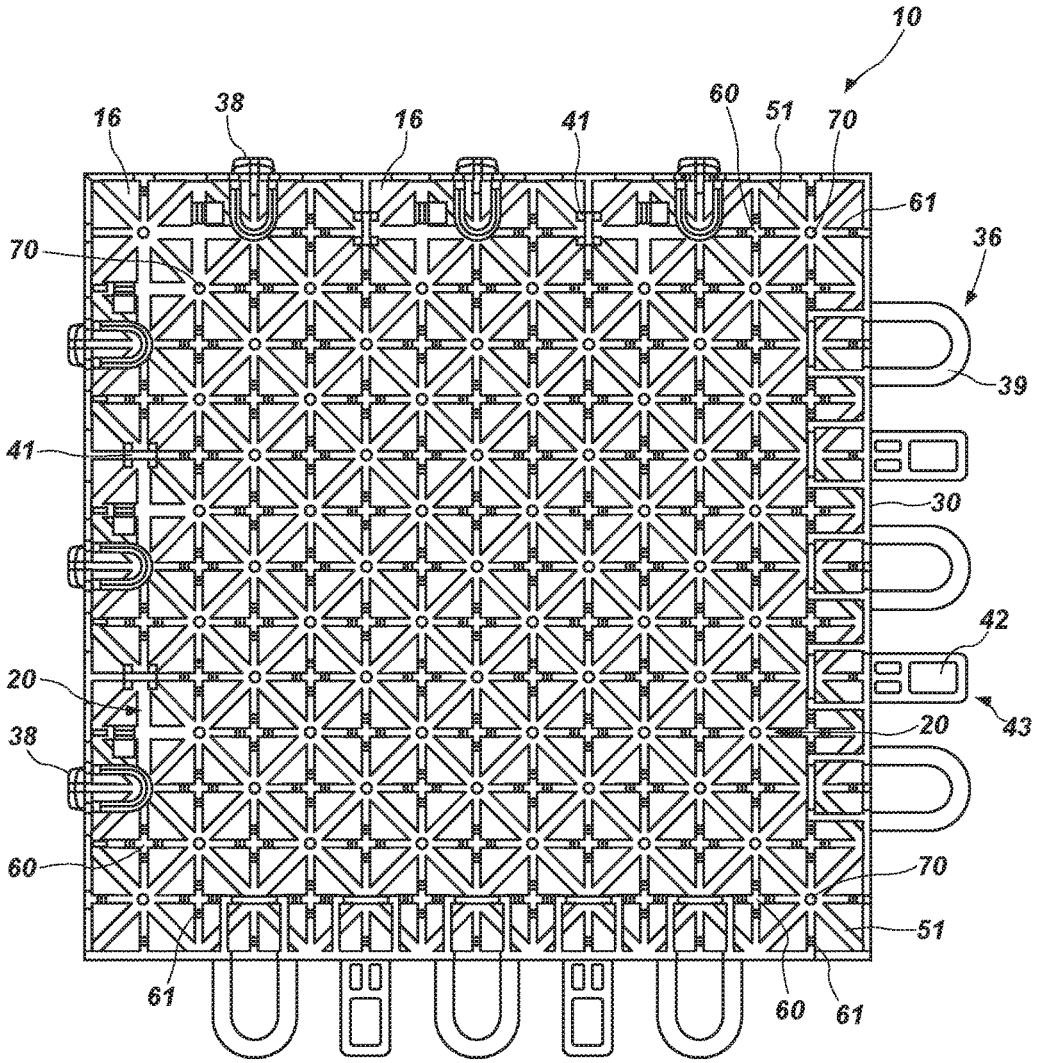
FIG. 2 is a bottom view of the synthetic modular floor tile of FIG. 1.
Figure 3:
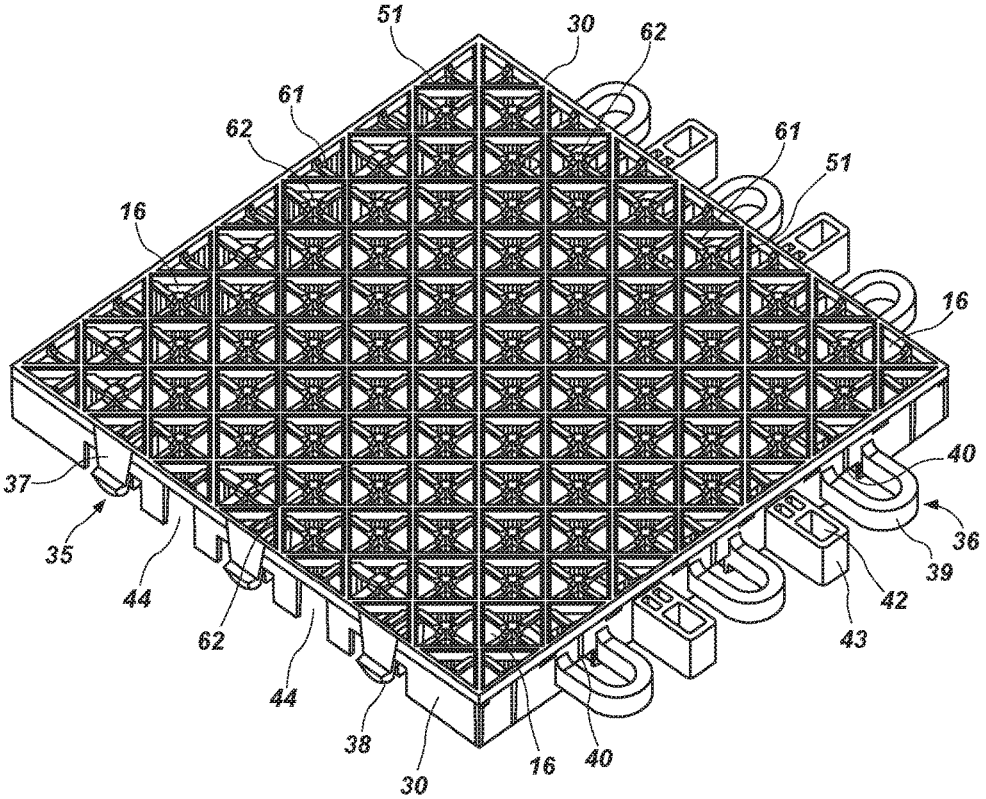
FIG. 3 is a top perspective view of the synthetic modular floor tile of FIG. 1.
Figure 4:
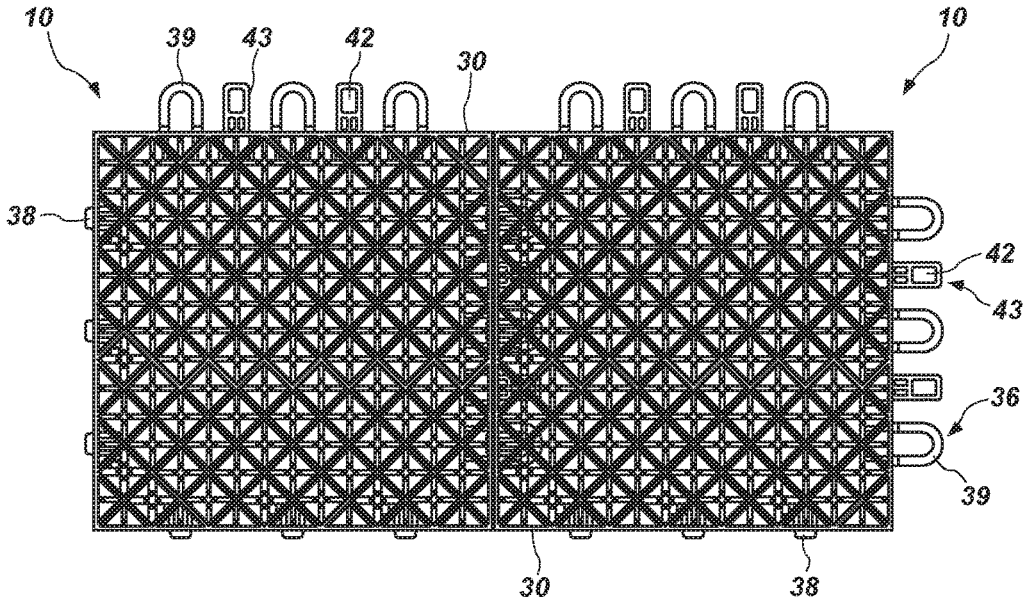
FIG. 4 is a bottom view of two modular floor tiles coupled together.
Figure 5:
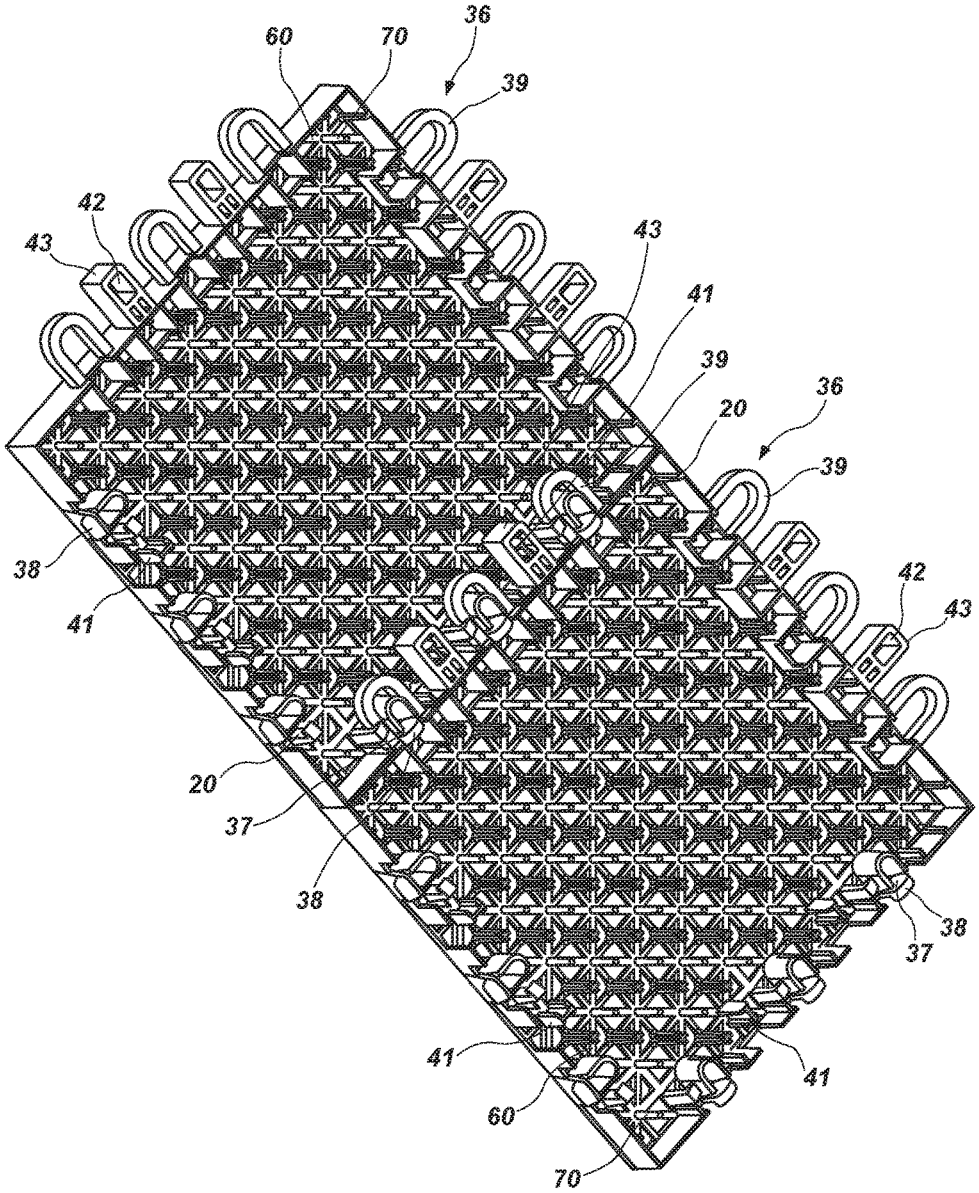
FIG. 5 is a bottom perspective view of two modular floor tiles coupled together.

The following detailed description of exemplary aspects of the technology makes reference to the accompanying drawings, which form a part hereof and in which are shown, by way of illustration, exemplary aspects in which the technology may be practiced. While these exemplary aspects are described in sufficient detail to enable those skilled in the art to practice the technology, it should be understood that other aspects may be realized and that various changes to the technology may be made without departing from the spirit and scope of the present technology. Thus, the following more detailed description of the aspects of the present technology is not intended to limit the scope of the technology, as claimed, but is presented for purposes of illustration only and not limitation to describe the features and characteristics of the present technology and to sufficiently enable one skilled in the art to practice the technology. Accordingly, the scope of the present technology is to be defined solely by the appended claims.

The following detailed description and exemplary aspects of the technology will be best understood by reference to the accompanying drawings, wherein the elements and features of the technology are designated by numerals throughout.

The present technology describes an improved modular floor tile having a top surface comprising a plurality of rib or structural members defining openings between the rib members. "Openings" refers to holes, gaps, or spaces through which a fluid or other object may pass. A perimeter of the tile is defined by outer edge surfaces. A support system is integrally formed from and disposed at least partially beneath the top surface. Generally speaking, the support system is capable of maintaining the top surface elevated above a ground surface. The support system comprises a primary support member disposed within the openings between the rib members. That primary support member is operably connected to a plurality of arms extending outward from the primary support member. The primary support member is configured for vertical movement within the opening when a load is applied to the top surface causing the arms to flex. A plurality of secondary support members, which are elevated above the ground surface when the tile is in an unbiased state, limit the vertical movement of the primary support member within the opening thereby limiting the downward movement of the tile when placed under a load. In this manner, loads placed on the top of the tile are absorbed by the flexing arms and further absorbed by the secondary support members. In another aspect of the technology, generally speaking, a modular floor tile is disclosed having a top surface. A plurality of edge surfaces defines a perimeter about the top surface and a support system is disposed at least partially beneath the top surface. A locking system allows for flexible displacement of a laterally extending protrusion having a flexible wall while placing a downward facing protrusion therein and/or allows for flexible displacement of flexible walls of a downward facing protrusion while placing said downward facing protrusion into a laterally extending protrusion.

With specific reference now to FIGS. 1-5, a modular tile 10 is shown and is configured to be coupled with adjoining modular tiles to form a floor covering for athletics or any other desirable purpose. The modular tiles provide enhanced impact absorbing characteristics to lessen fatigue and minimize injury resulting from activities on rigid surfaces such as concrete, asphalt and the like. The tiles may be formed from any suitable rigid or semi-rigid material, such as a polymeric material, and may be formed using molding techniques known in the art such as injection molding, compression molding and the like and are formed or molded in a single, integrated tile. In a preferred embodiment, the tiles are not made of substantially compressible material (such as soft rubber) as they do not provide adequate ball-bouncing characteristics or are otherwise undesirable for sports or other activities.

The modular tile 10 includes a top surface 15 with an opposite bottom side 20. The top surface 15 can be smooth, perforated, grid-like, bumped, textured, or have any other configuration as suits a particular purpose for a synthetic floor covering. The top surface 15 includes a periphery with a square or rectangular shape defining a front side 25, a rear side 26, and opposing first and second sides 27, 28. Other suitable peripheral shapes for the tiles are contemplated herein such as triangular, hexagonal, etc. Each of the front side 25, rear side 26, and first and second sides 27, 28 include side walls 30 with one or more male or female coupling members 35, 36 for adjoining adjacent tiles. Male member 35 comprises a downward post structure 37 with a laterally extending tab 38. The female member 36 comprises a loop 39 configured to receive the post structure 37 therein with the tab member 38 positioned beneath the sidewall 40.

Additional male and female coupling members are disposed about the sides of the tiles and are configured to provide additional connection for the tiles. Male post member 41 is disposed about the bottom side 20 of the tile 10 and is configured to be positioned within the opening 42 in female member 43. Female member 43 is configured for placement within aperture 44 in sidewall 30. Male post member 41 comprises a general I-shape having a longitudinal axis substantially equivalent in length to the longitudinal length of the opening 42 in female member 43. The height of the aperture 44 is equivalent to the height of the female member 43.

Figure 6:
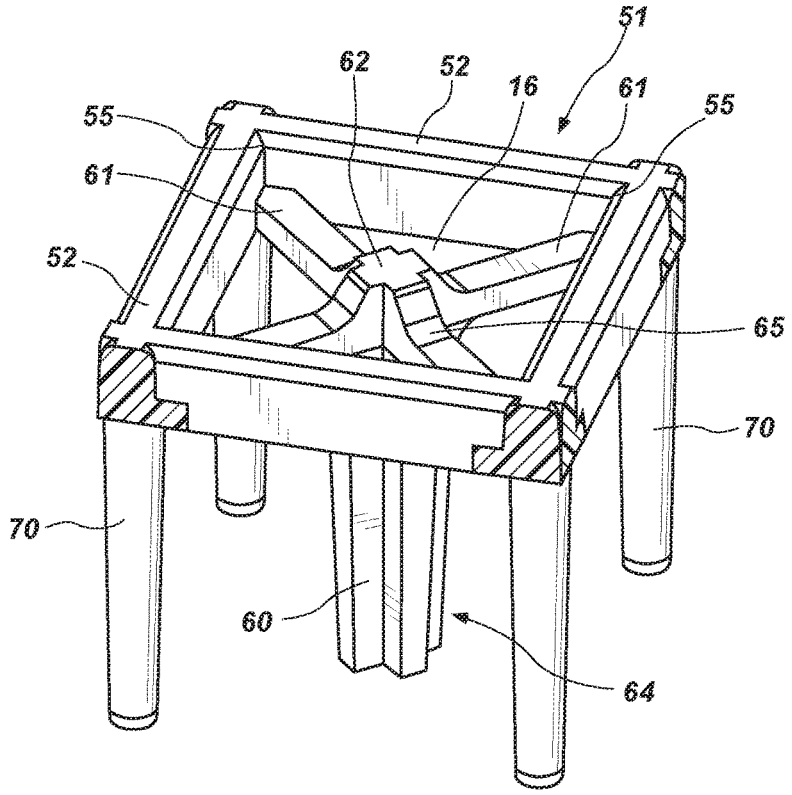
FIG. 6 is a top perspective view of an opening and support system of a portion of a synthetic modular floor tile in accordance with one aspect of the technology.
Figure 7:
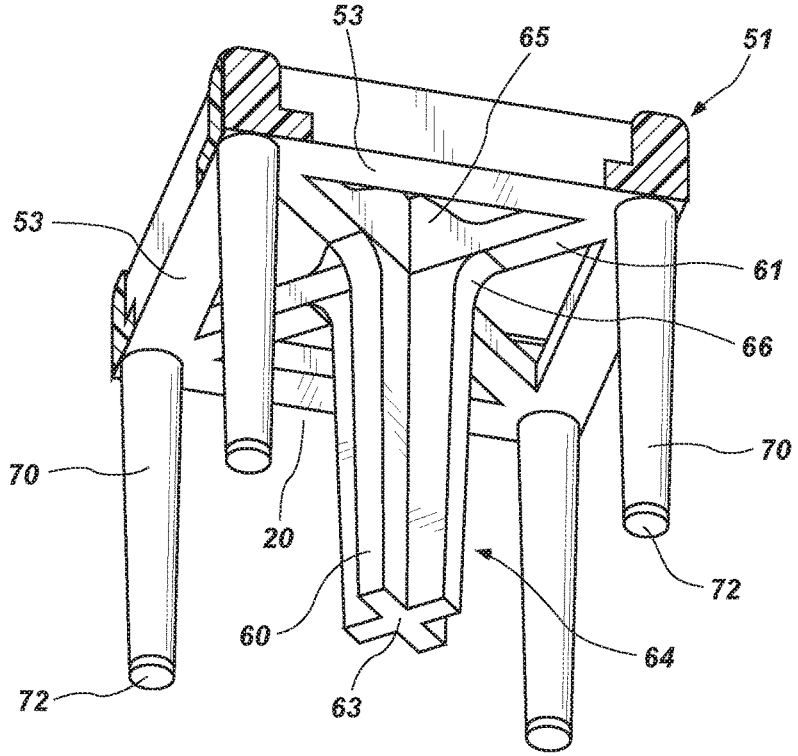
FIG. 7 is a bottom perspective view of FIG. 6.
Figure 8:
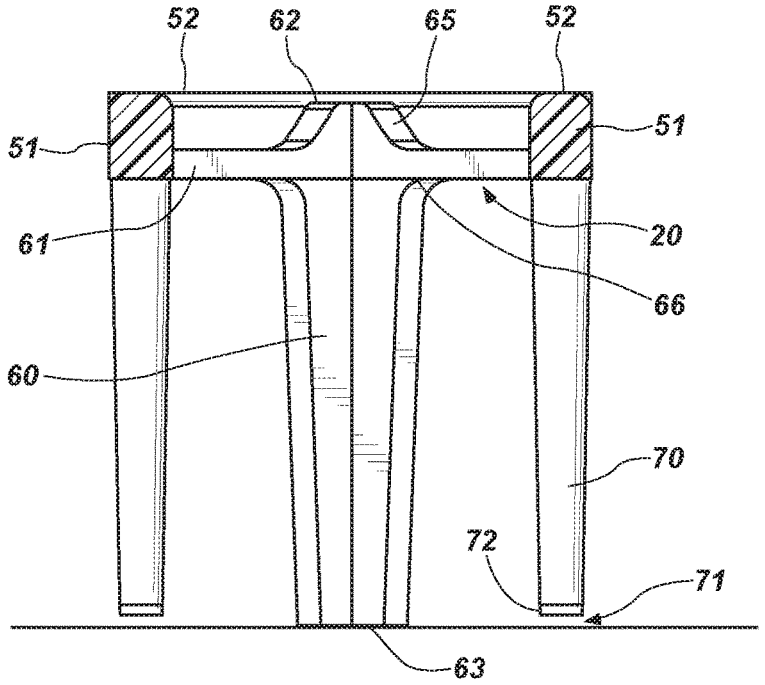
FIG. 8 is a side view of FIG. 6 with no load placed on the top of the portion of the synthetic modular floor tile.
Figure 9:
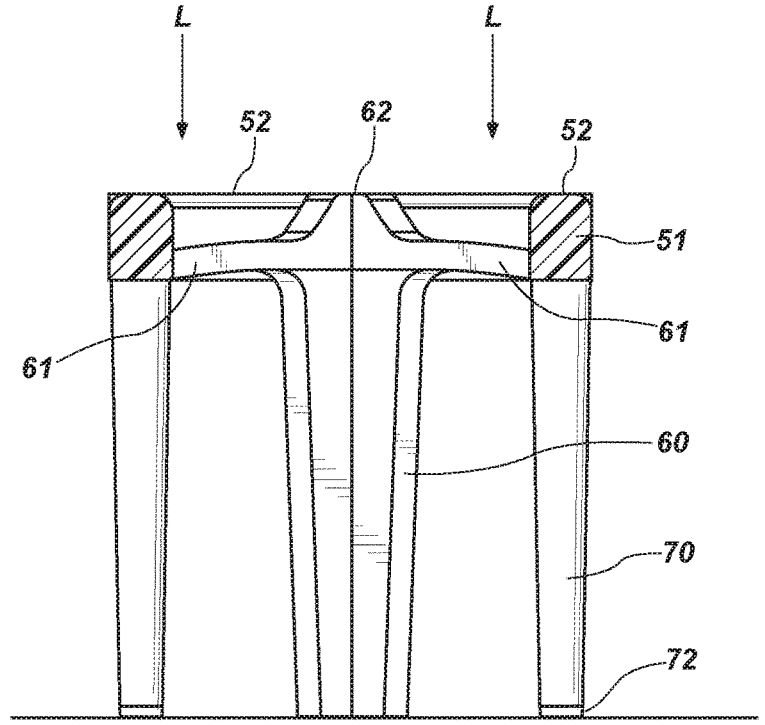
FIG. 9 is a side view of FIG. 6 showing a load placed on the top of the portion of the synthetic modular floor tile and the resulting flex action of the arms in accordance with one aspect of the technology.

With reference generally to FIGS. 1-5 and specifically to FIGS. 6 and 7, the bottom side 20 of tile 10 includes a support grid configured to support the top surface 15 about the ground. In accordance with one aspect of the technology, the top surface 15 comprises a plurality of openings 16 that are defined by structural members 51. In one aspect, the structural members 51 comprise intersecting rib members. An upper plane of the opening 16 is defined by the upper surface 52 of the intersecting rib members 51. A bottom plane of the opening 16 is defined by the bottom surface 53 of the intersecting rib members 51. The openings 16 are further defined by sidewalls 56 of the rib members 51. The support grid comprises a plurality of primary post structures 60 disposed about the bottom 20 of the tile 10. As the term is used herein, "post" refers to a generally upright structure that tends to be vertical and has a height that is greater than its width. When the tile 10 is placed on a ground surface and is in an unbiased state (i.e., no load is placed on the top of the tile), the primary support posts 60 are the only portion of the tile 10 in contact with the ground surface. The top 62 of the support post 60 is disposed within the center of the openings 16 and within the area defined by the upper and lower planes of the openings.

In one aspect of the technology, the post structure is generally cross-shaped. However, the use of different shapes and configurations (cylindrical, rectangular, triangular, etc.) are contemplated for use herein so long as the support function is accomplished. The primary support post 60 is formed from the same material used for the top surface 15 of the tile 10 and arms 61. In one aspect of the technology, the support posts 60 are formed from the same mold used to form the entire tile 10. The primary support posts 60 are coupled to the tile 10 by a plurality of arms 61 extending outward from primary support posts 60. The primary support posts 60 are disposed within the center of the opening 16 having arms 61 extending laterally away from the post 60 and connecting to the ribs 51 at the vertex 55 of intersecting rib members. The arms 61 are generally rectangular but may also be triangular, circular, or shaped like a rhombus or other desirable shape. In one aspect of the invention, the arms 61 have substantially parallel top and bottom surfaces. The top surface is narrower than the bottom surface and substantially centered over the top surface. The side surface tapers outwardly from the top surface to the bottom surface.

When moving on a conventional floor, the force associated with jumping, walking, or running on the floor is transferred directly between the floor and the foot of the person. This results in fatigue and possible injury. Advantageously, with aspects of the present technology, when a load is placed on the top surface 15 of the tile 10, the arms 61 flex, allowing the tile 10 to move downward. Because the top 62 of the primary support posts 60 is located within the opening 16 and is unencumbered by a rigid material above the structure, the ribs 51 move downward over the primary support posts 60 as the arms 61 flex. The flexing operation of the arms 61 absorbs some of the impact associated with the load placed on the top 15 of the tile 10 and thereby lessens the transfer of force from the ground to the foot of the person.

In one aspect of the technology, a top 62 of the primary post structure 60 is disposed below the upper plane of the opening 16 but above the bottom plane of the opening 16. The arms 61 are connected to the primary post 60 near the top 62 of each portion of the cross 64 forming the primary support post 60. A taper on the top 65 and bottom 66 portion of each arm 61 is formed as a transition between the arm 61 and primary support posts 60. A bottom 66 of the arm 61 is coplanar with a bottom 53 of the ribs 51. However, in another aspect, a top 65 of the arm 61 is coplanar with a top 52 of the ribs 51. In one aspect of the technology, the arms 61 extend outward from the primary support post 60 near the top 62 or directly from the top 62, though the arms 61 may connect to the primary support post 60 at any location along the support posts 60 as suits a particular design.

Figure 10:
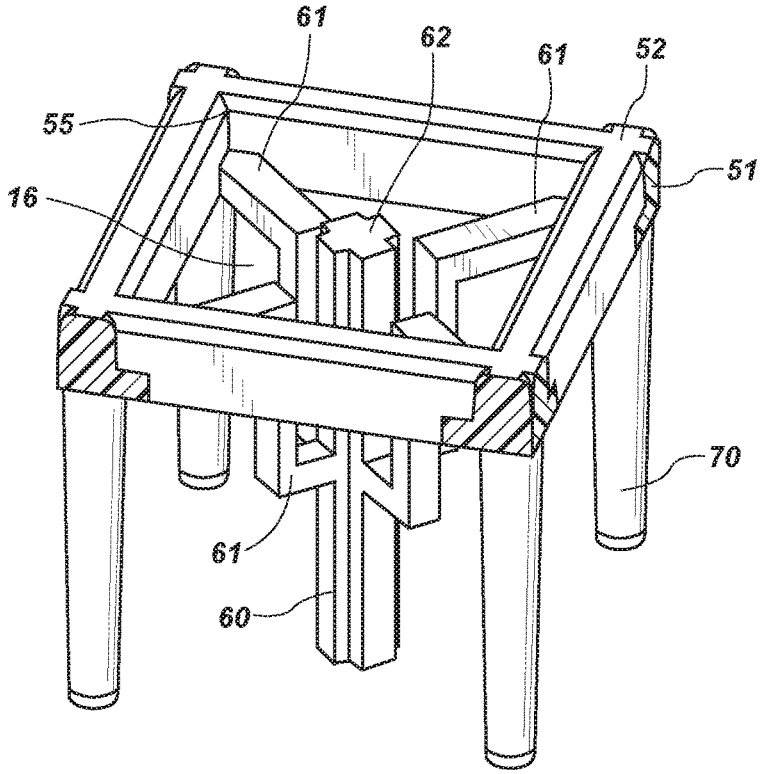
FIG. 10 is a top perspective view of an opening and support system of a portion of a synthetic modular floor tile in accordance with one aspect of the technology.
Figure 11:
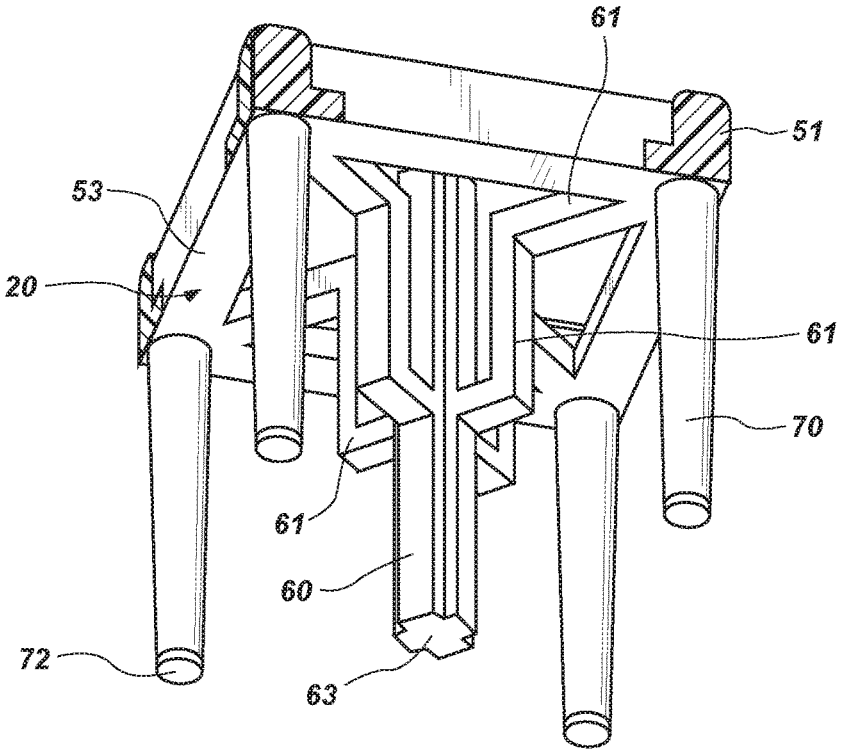
FIG. 11 is a bottom perspective view of FIG. 10.

For example, with reference generally to FIGS. 10 and 11, the arms 61 are connected to the primary support post 60 at a position near the middle of the primary support post 60. In another example, the arms 61 may connect to the primary support post 60 near the bottom of the primary support post 60. In either of these examples, the arms 61 can extend upward as well as laterally to couple to the rib members 51 at the vertex 55 of intersecting ribs 51. Additionally, while the arms 61 are shown as plurality of elongate members, the arms 61 may comprise a plurality of different members in various shapes and configurations, including, but not limited to, an L-shaped or arcuate shaped arm. Different arm configurations may be used to absorb the loads placed on the tile 10 so long as the arms 61 flex to absorb the load. Advantageously, no separate insert or secondary material is required to absorb a load placed on the tile 10.

Figure 12:
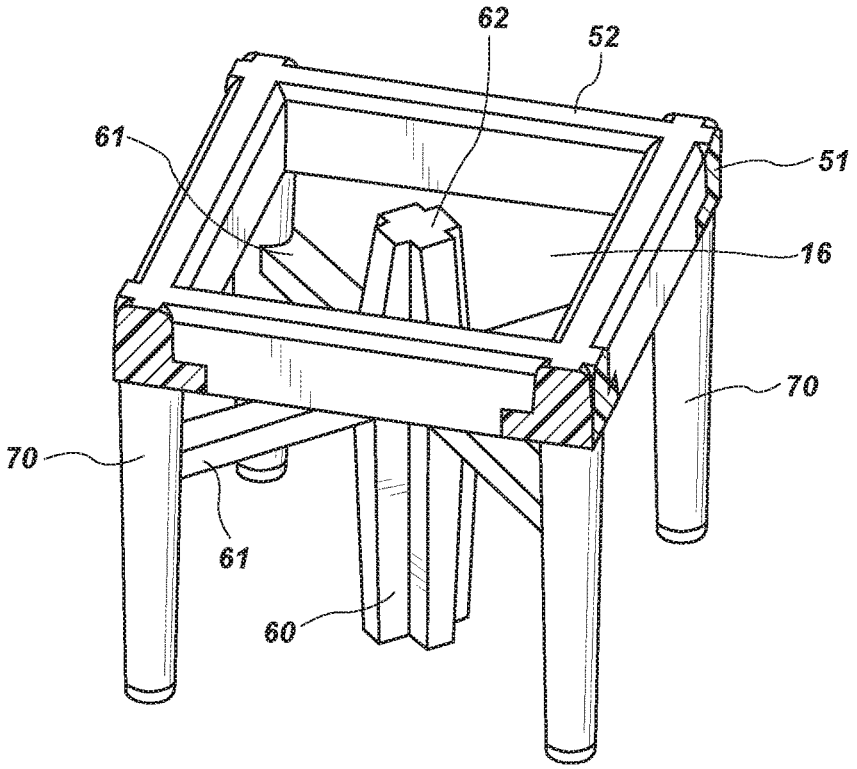
FIG. 12 is a top perspective view of an opening and support system of a portion of a synthetic modular floor tile in accordance with one aspect of the technology.
Figure 13:
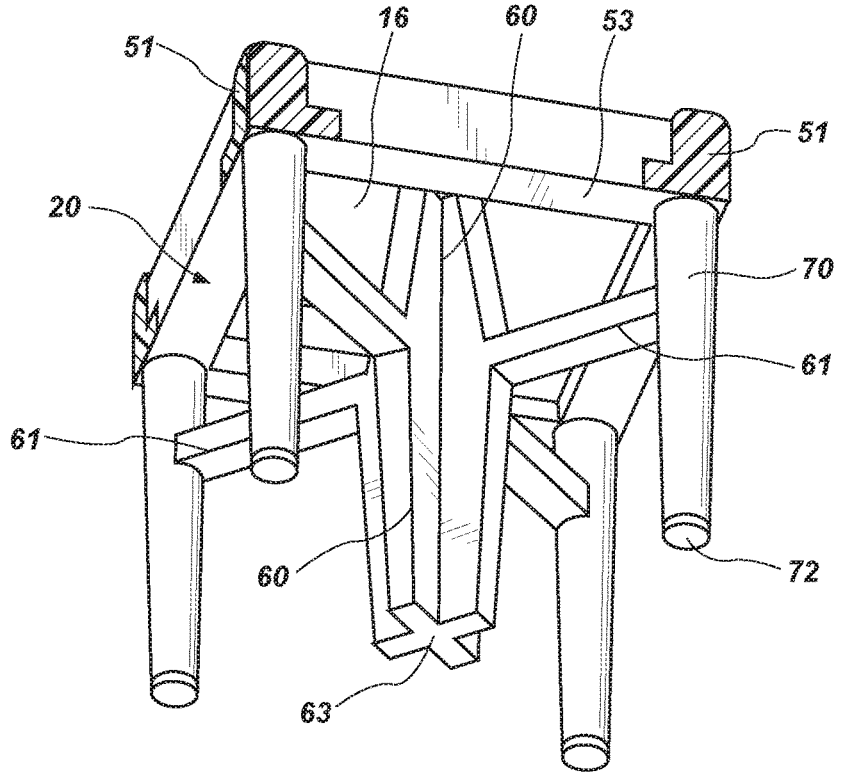
FIG. 13 is a bottom perspective view of FIG. 12.
Figure 14:
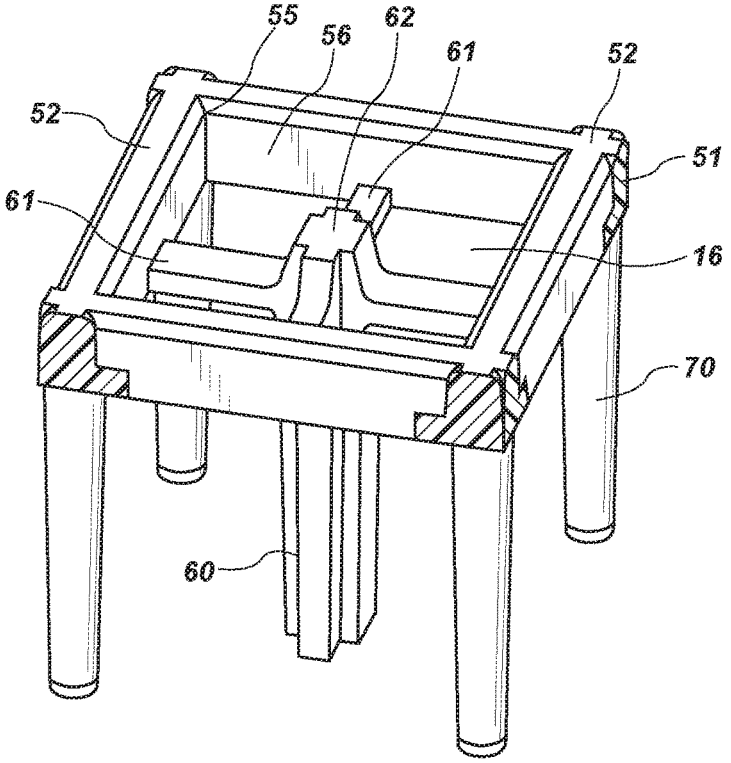
FIG. 14 is a top perspective view of an opening and support system of a portion of a synthetic modular floor tile in accordance with one aspect of the technology.
Figure 15:
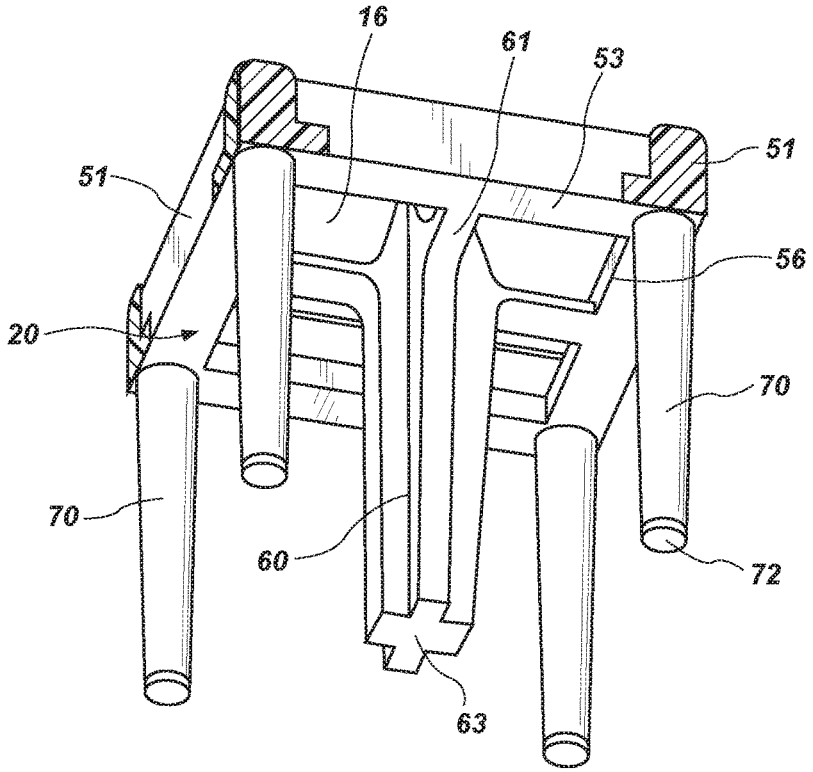
FIG. 15 is a bottom perspective view of FIG. 14.

With reference now to FIGS. 12 and 13, in another aspect of the technology, the arms 61 are connected to the primary support post 60 near the middle of the primary support post 60 and extend outward laterally to couple (i.e., connect) to secondary support posts 70. In this aspect, it is not necessary for the arms 61 to couple to the tile 10 at the vertex 55 of interconnecting ribs 51. In other aspects, the arms 61 can extend outward from the primary support post 60 and connect to ribs 51 along the inner side wall 56 of a rib 51 (see, e.g., FIGS. 14 and 15). Additionally, it is not necessary that the arm 61 necessarily connect to the rib 51 near a bottom 53 of rib 51. Rather, the arm 61 can couple to the rib 51 near an upper surface 52 of the rib 51.

With reference generally to FIGS. 5 through 9, a plurality of secondary support posts 70 are disposed about the bottom 20 of the tile 10 and arrayed about the primary support posts 60. In accordance with one aspect of the technology, the secondary support posts 70 have a longitudinal length that is less than the length of the primary support posts 60. In this manner, the primary support post 60 acts to maintain the secondary support posts 70 a distance 71 above the ground when the tile 10 is in an unbiased (i.e., no load) state. When a load "L" is placed on the top of the tile 10, the arms 61 flex allowing the tile 10, including the secondary support posts 70, to move downward. The secondary support posts 70 limit downward movement of the tile 10 and prevent overflexing of the arms 61 which can result in plastic deformation of the arms 61. In one aspect of the technology, the distance from the top 62 of primary support post 60 and the distance 71 between the ground and the bottom of support posts 70 are substantially the same. That is, the length of the secondary support posts 70 and primary support posts 60 are reconciled so that when a load L is placed on the tile 10, the secondary support posts 70 come into contact with the ground and the top 62 of the primary support post 60 is in substantially the same plane as the top 52 of the ribs 51. In this manner, the total surface area available for frictional contact between the foot of a person and the tile 10 is temporarily increased during activity on the tile 10. Advantageously, because the secondary support posts 70 limit the upward movement of the primary support post 60 through the upper plane of the opening 16, the top 62 of the primary support post 60 does not become a raised surface that may increase abrasion during a fall yet still acts to increase the total surface area of the playing surface. Because the arms 61 elevate the tile 10 above the ground surface when it is in an unloaded state, when loaded, the arms 61 act as a spring containing an amount of potential energy. In this manner, the biased arms 61 create an upward force (or spring) to help give added mobility to the person running, jumping, walking, etc. on the floor tile 10.

In another aspect of the technology, the top 62 of the primary support post 60 can be disposed beneath the opening 16 when the tile 10 is in an unbiased state. When a load "L" is placed on the top 15 of the tile, the top 62 of the primary support post 60 can advance upward to beneath the upper surface 52 of ribs 51, co-planar with the upper surface 52 (as shown in FIG. 7), or above the upper surface 52 of the ribs 51 as suits a particular application. The sidewalls 40 about the perimeter of the tile 10 are also configured to have a length similar to the length of the secondary support posts 70. In this manner, the sidewalls 40 also limit the vertical travel of the primary support post 60. In addition, while the top 62 of the primary support post 60 is shown as planar, it may also have a dome-like structure. In this manner, if it is desired that the top 62 of the primary support post 60 terminate in its vertical travel slightly above the top surface 52 of the rib members 51, additional traction may be created without creating unwanted abrasion.

Figure 16:
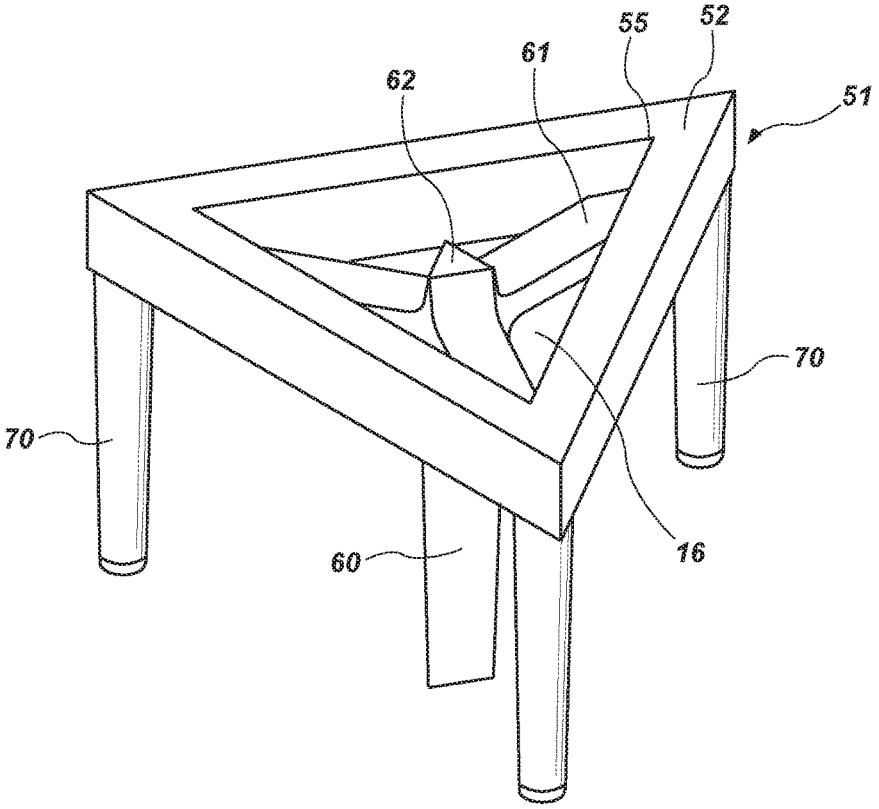
FIG. 16 is a top perspective view of an opening and support system of a portion of a synthetic modular floor tile in accordance with one aspect of the technology.
Figure 17:
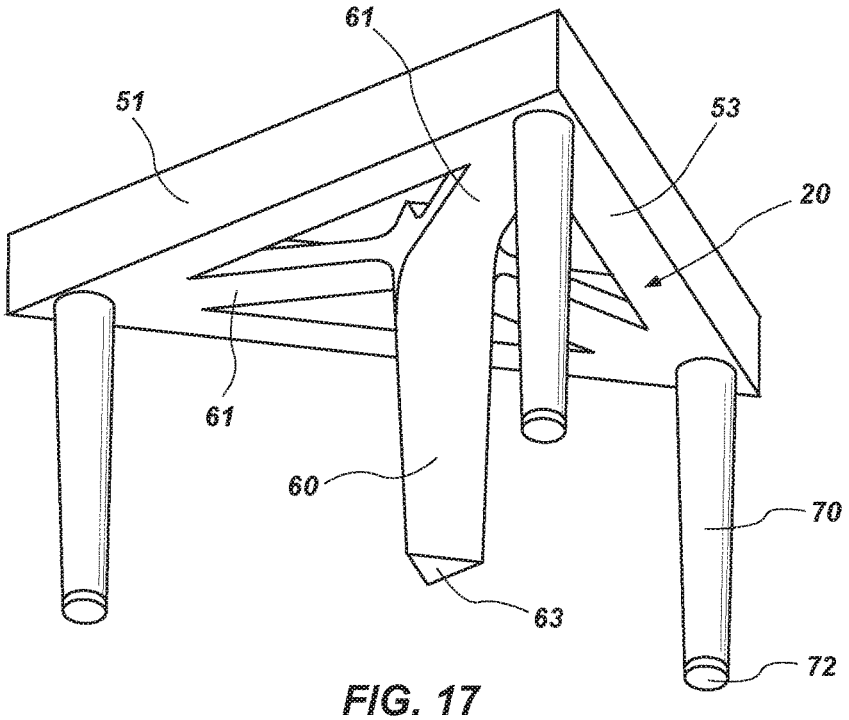
FIG. 17 is a bottom perspective view of FIG. 16.
Figure 18:
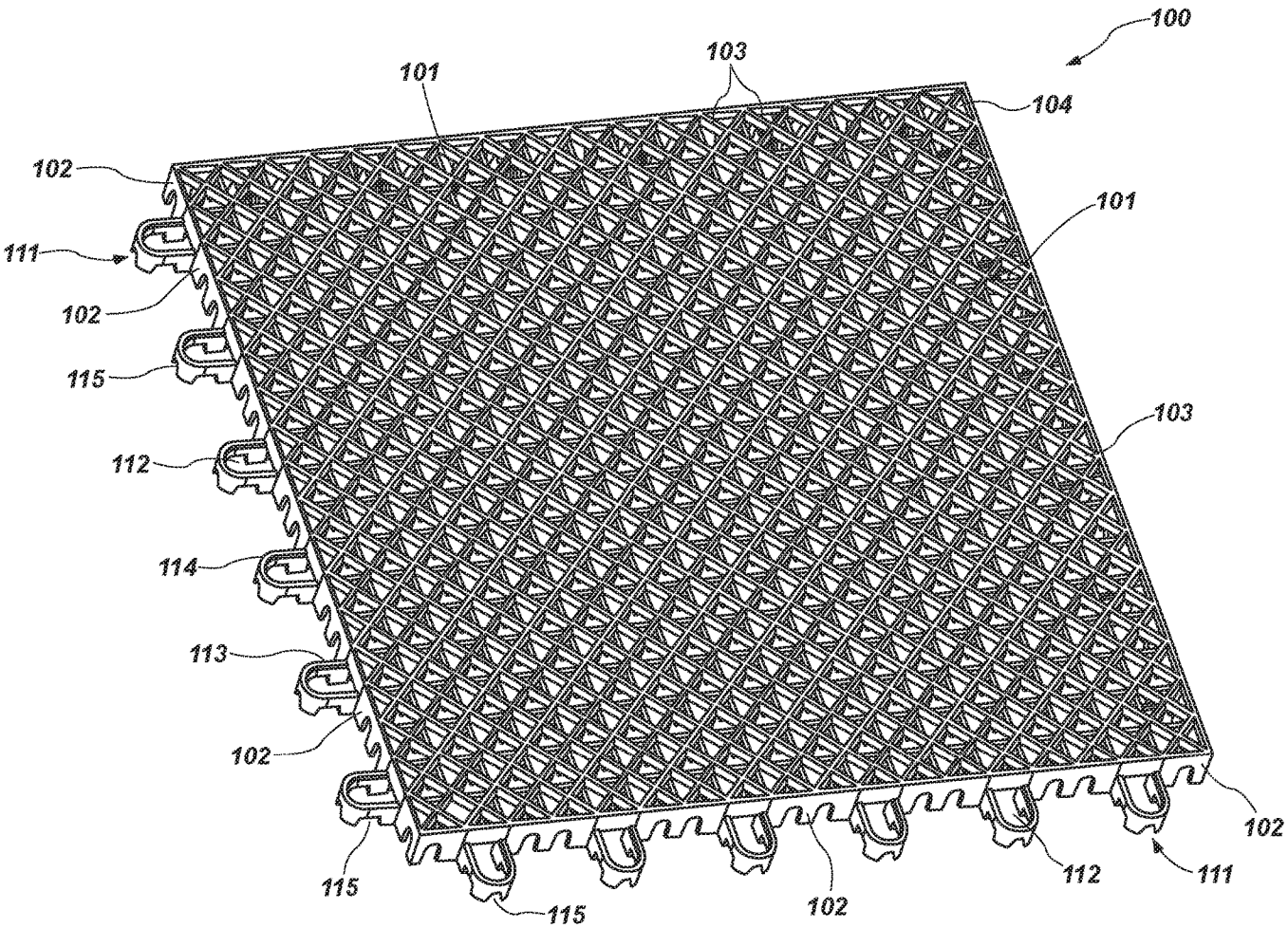
FIG. 18 is a perspective view of a modular floor tile in accordance with one aspect of the technology.
Figure 19:
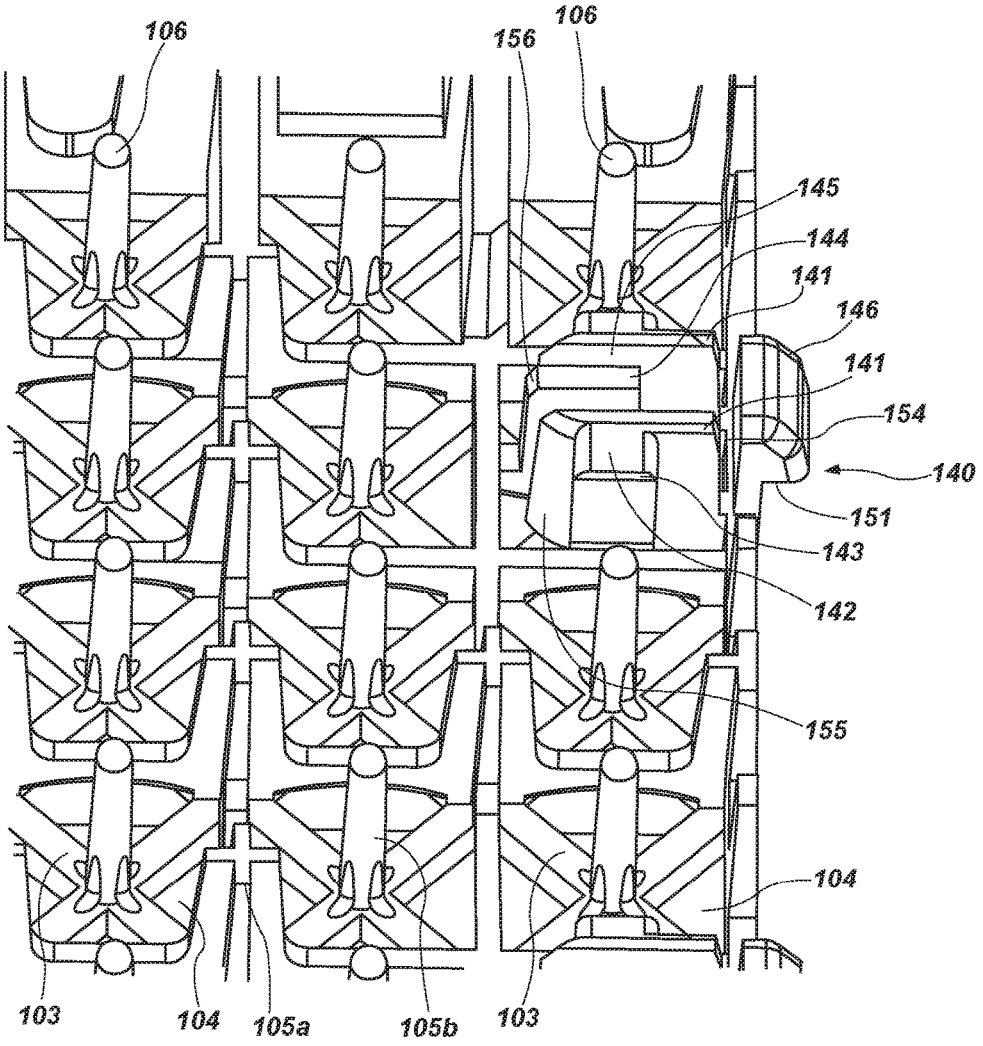
FIG. 19 is a bottom perspective view of a portion of the floor tile of FIG. 18.
Figure 20:
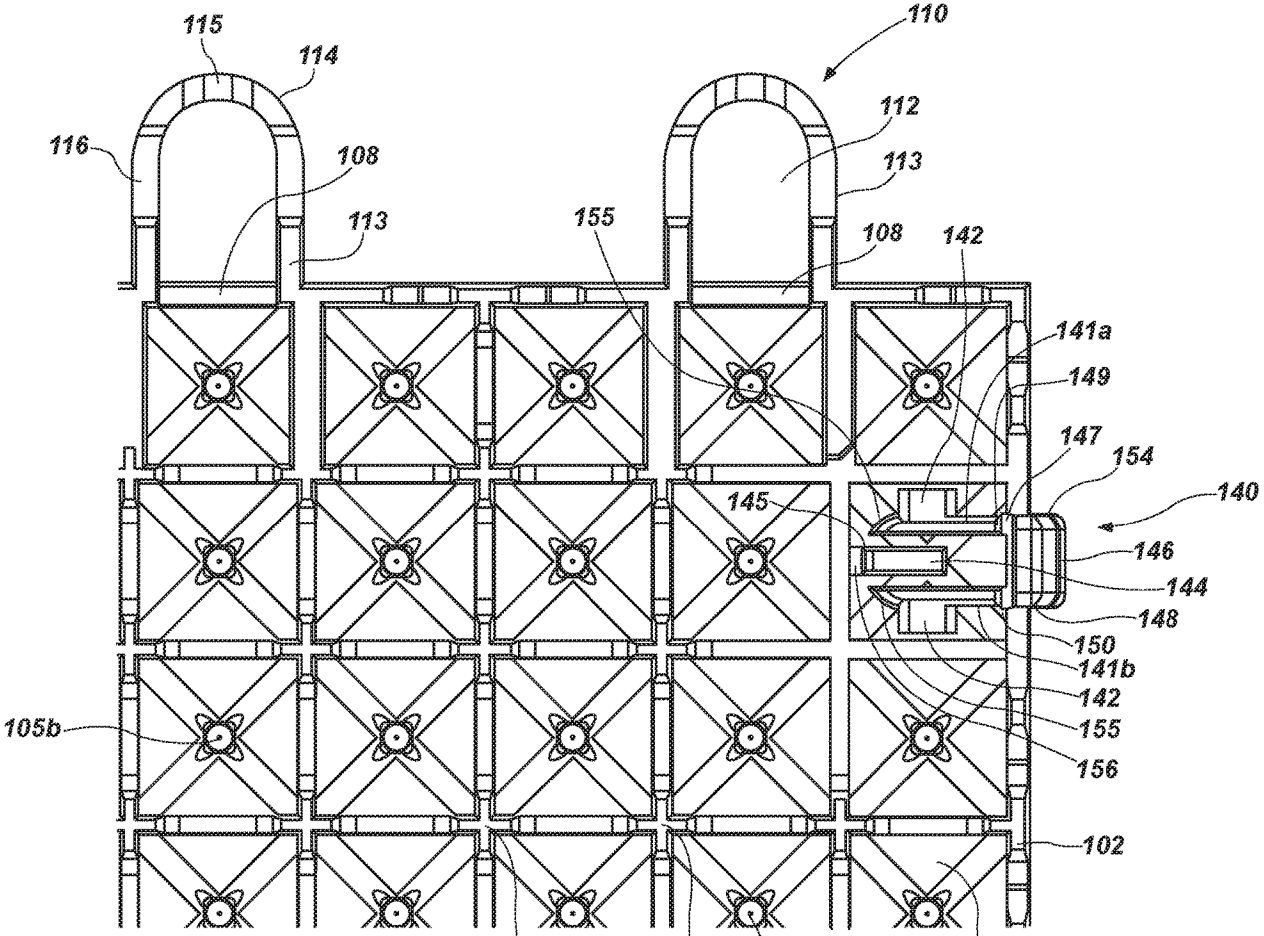
FIG. 20 is a bottom view of a portion of the floor tile of FIG. 18.
Figure 21:
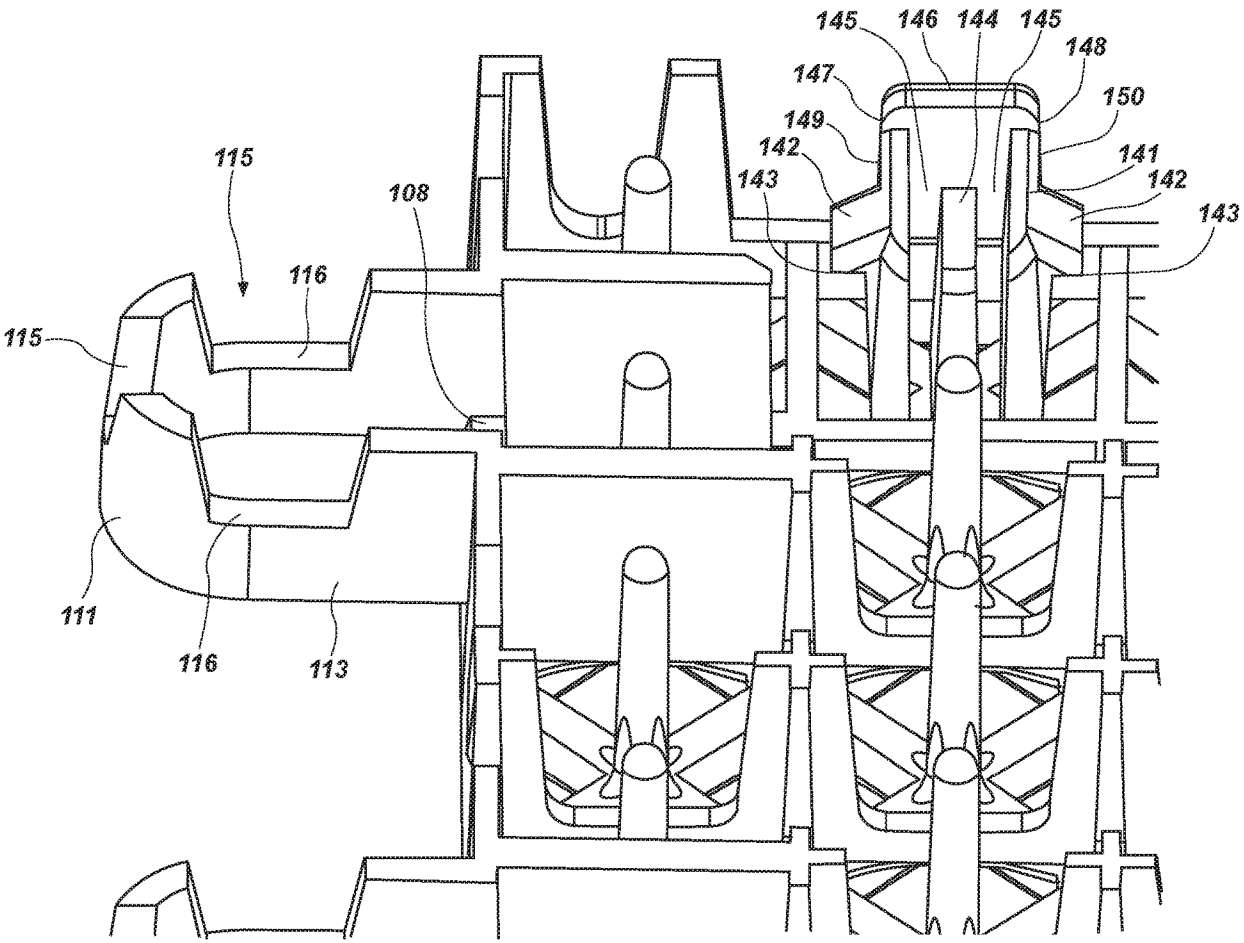
FIG. 21 is a bottom perspective view of a portion of the floor tile of FIG. 18.
Figure 22:
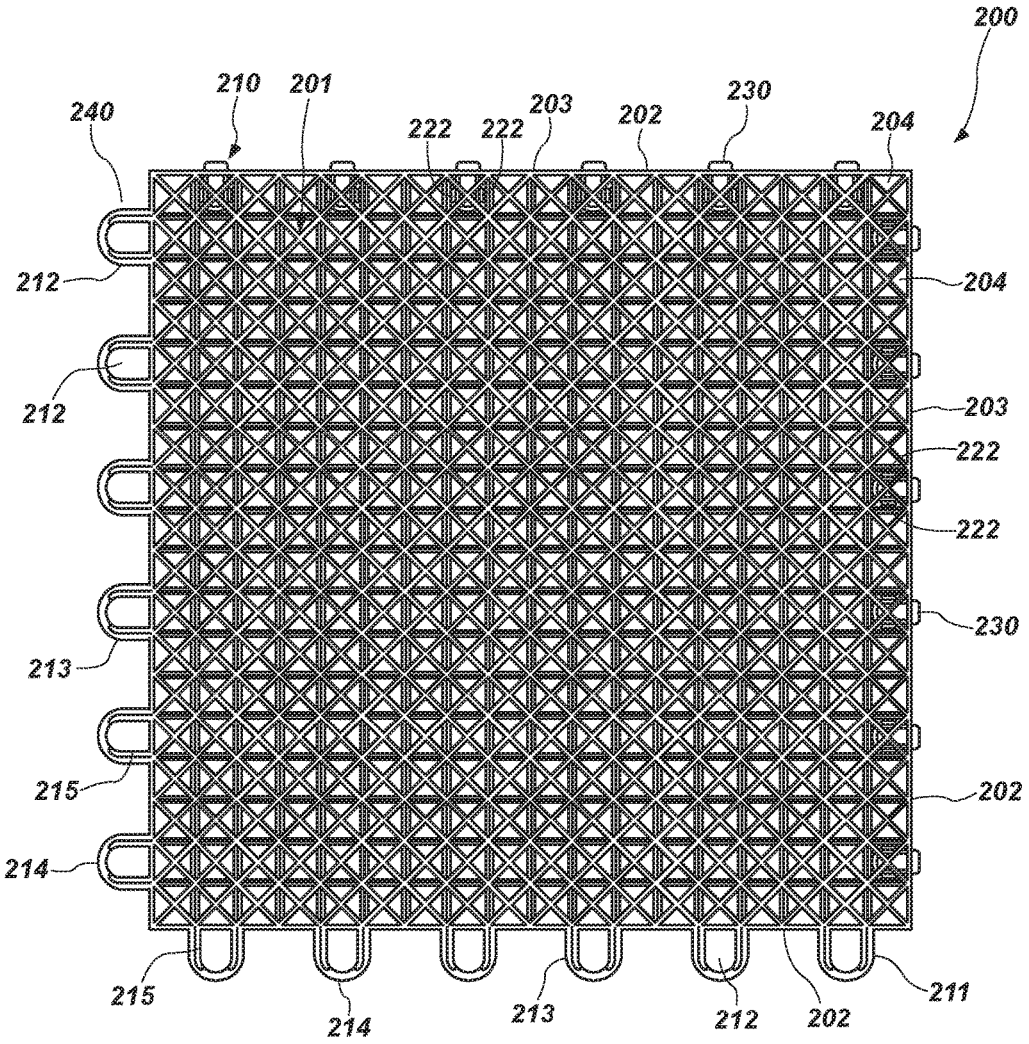
FIG. 22 is a top view of a floor tile in accordance with one aspect of the technology.
Figure 23:
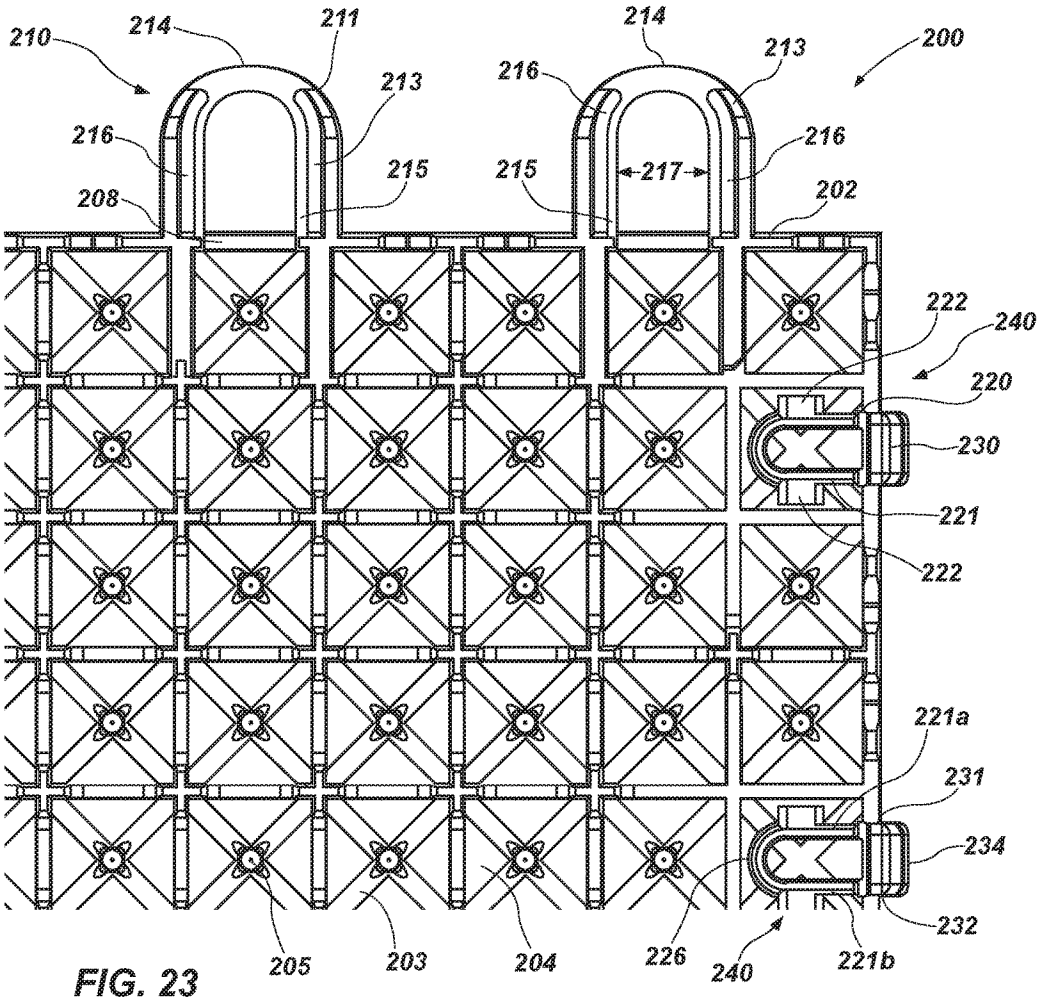
FIG. 23 is a bottom view of a portion of the floor tile of FIG. 22.
Figure 24:
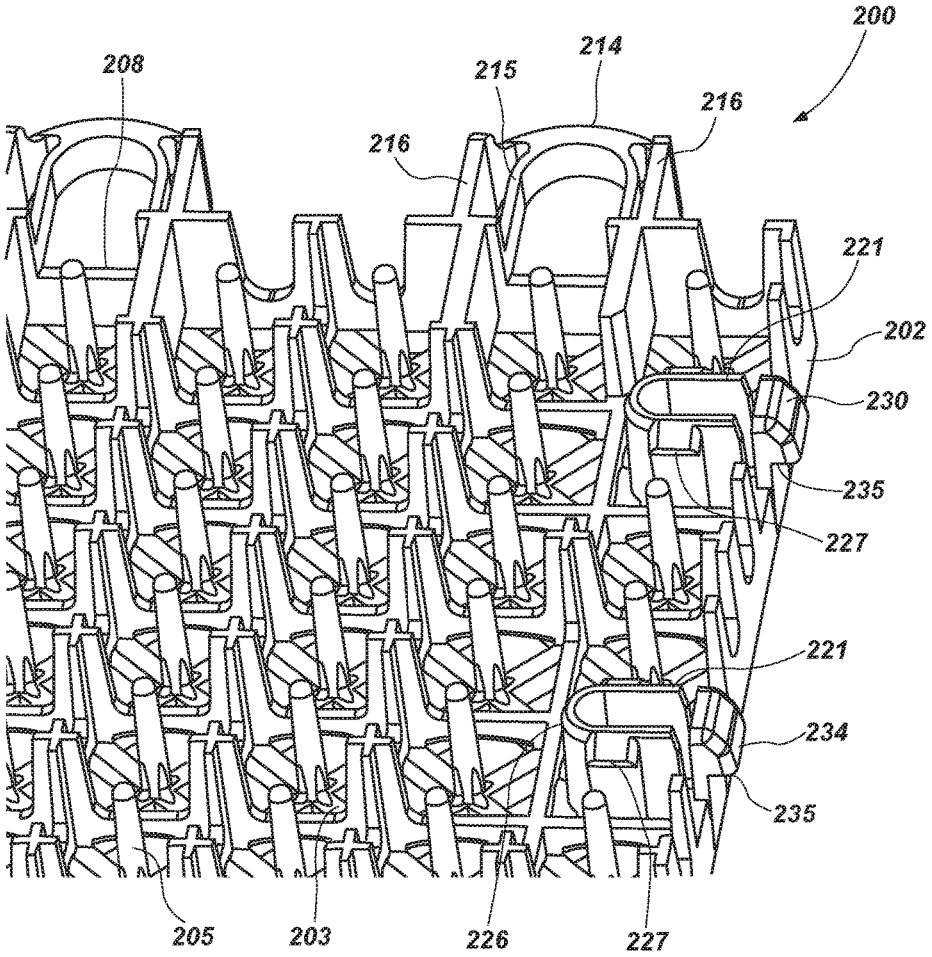
FIG. 24 is a bottom perspective view of a portion of the floor tile of FIG. 22.

In accordance with one aspect of the technology, and by way of example only, the rib members 51 range from approximately 0.05 to 0.25 inches wide and 0.05 to 0.5 inches in height. The primary post structure 60 ranges from 0.25 to 1 inch in height and the secondary post structures 70 range from 0.25 to 1 inch in height. The area within the openings 16 can range from 0.15 square inches to 3.25 square inches and can be rectangular as shown in FIGS. 6 through 14, triangular as shown in FIGS. 16 and 17, circular, or any other shape as suits a particular design. With reference to the triangular openings shown in FIGS. 16 and 17, the primary support post 60 resides within the center of the opening 16 similar to the disposition within a rectangular opening. A plurality of arms 61 extend outward from the primary support post 60 and connect to the vertex 55 of intersecting rib members 51. As with the rectangular openings, it is not necessary for the arms 61 to connect to the rib members 51 at the vertex 55 of intersecting rib members 51. Rather, the arms 61 may connect to the rib members 51 at an inner side wall. In one aspect, the arms 61 do not connect to the rib members 51. Rather, the arms 61 extend outwardly from the primary support post 60 and connect to the secondary support posts 70. A plurality of three secondary support posts 70 are arrayed about the primary support post 60. The secondary support posts 70 extend downward from the bottom 20 of the tile 10 near the vertex 55 of intersecting rib members 51. Similar modifications to the triangular opening embodiment may be made as discussed above with respect to the rectangular opening. For example, the arms 61 need not be single elongate members and the arms 61 need not couple to the primary support post 60 near the top 62 of the support post 60. Moreover, the shape of the primary support post 60 and secondary support post 70 may be varied as suits a particular application and design.

While specific reference is made herein to an open-top tile configuration, a closed-top tile configuration is also contemplated. In one aspect of the technology, intersecting rib members 51 may not act as the upper contact surface for the end-user of the tile 10. Rather, a substantially planar playing surface may be placed on the rib structure described herein with modifications to the placement and design of the primary support post 60 within the opening 16. In this aspect, the distance between the top 62 of the primary support post 60 and the bottom of the planar surface is greater than the distance 71 between the bottom of secondary support posts 70 and the ground surface. In this manner, the flexing action of arms 61 absorbs impact on the top surfaces of the tile 10. The vertical travel of the primary support post 60 is limited by the secondary support posts 70, not by any encumbrance between the top 62 of the primary support post 60 and the bottom of the planar playing surface.

While specific reference is made herein to a top surface 15 comprising intersecting ribs 51, it is understood and contemplated herein that a number of surface configurations may be used. For example, a substantially solid top surface may be used having a plurality of openings 16 disposed therein. The openings 16 may be circular, rectangular, or triangular, or any other desirable shape, and can be molded as part of the tile 10. Importantly, whatever the shape of the opening 16 and whatever the configuration of the top surface (be it intersecting ribs or otherwise), a primary support post 60 is disposed substantially within the center of the opening 16; the primary support post 60 having at least two arms 61 extending outward from the support post 60 and being coupled to the tile 10 in some fashion. As noted above, the arms 61 can couple to the sidewall of the opening 16, a corner of the opening 16, secondary support members 70 (also discussed above) or to a bottom portion 20 of the tile 10 and flex in response to a load being placed on a top 15 of the tile 10, allowing vertical travel of the primary support post 60.

In one aspect of the technology, a flexible or compressible material (such as rubber or the like) may be placed beneath the tile 10 to further absorb the load. In this aspect, the secondary support members 70 are substantially shorter than the primary support members 60 and the flexible material is placed about the bottom 20 of the tile 10 to further absorb the load placed on the top 15 of the tile 10 and limit the flexing action of the arms 61. The secondary support posts 70 contact the ground only after the flexible material is compressed.

In accordance with one aspect of the technology, more than one primary support post 60 can be placed within any one opening of the tile 10. For example, two primary support posts can be placed within the center of a rectangular opening. The two primary support posts can be connected by a single arm. Two arms can extend from each one of the primary support posts and couple with the two closest vertices of the rectangular opening.

A method of absorbing at least a portion of a load applied to a top of a flooring surface is also contemplated herein. The method comprises providing a modular floor tile disposed about a ground surface. The floor tile comprises a substantially flat upper playing surface having a plurality of ribs with spaces between the ribs, a bottom surface, and side surfaces forming a periphery about the tile. A plurality of secondary support posts are formed from and extend downward from the bottom of the floor tile. A plurality of vertically moveable primary support posts are disposed within the opening between the ribs and coupled to the ribs by a plurality of flexible arms extending laterally outward from the primary support posts and integrally formed with the ribs. The flexible arms are biased to position the vertical support members downward such that a bottom of the secondary support posts is elevated a distance above the ground surface when the tile is in an unloaded state. A load is placed on the upper playing surface causing the plurality of arms to flex facilitating upward movement of the vertically moveable primary support posts within the opening of the ribs and concurrent downward movement of the floor tile until the bottom of the secondary support members contact the ground surface. The method further comprises releasing the load on the upper playing surface causing the plurality of arms to return to a biased state, positioning the primary support members downward and elevating the secondary support posts above the ground surface.

With reference generally now to FIGS. 18-21, in one aspect of the technology, a flooring component or modular flooring tile 100 is shown. The tile 100 comprises a top surface 101 and a plurality of side edge surfaces 102 defining a perimeter about the top surface 101. The top surface 101 has a plurality of intersecting rib members 103 defining apertures 104.

However, it is understood that in certain aspects of the technology the top surface 101 may comprise a continuous surface with no apertures as suits a particular application. A support system, including a plurality of post structures 105 is disposed at least partially beneath the top surface 101. In one aspect of the technology, the post structures 105 comprise primary support structures **105*a* and secondary support structures 105*b*. The secondary support structures 105*b* extend downward from the top surface 101 a distance greater than the primary support structures 105*a* and have rounded tips 106 to facilitate lateral deflection of the secondary support members 105*b* when a load is placed on the top surface 101**.

In one aspect of the technology, male and female coupling members 110 and 140 are disposed about the tile 100 and provide a locking system for adjacent tiles. In accordance with one aspect of the technology, the female coupling member 110 comprises a protrusion 111 extending outward from a side edge 102 of the tile 100. The protrusion 111 comprises a pass through opening 112 and side walls 113 that couple to the side edge 102 of the tile 100. In one aspect of the technology, the sidewalls 113 of the protrusion 111 are joined together at a distal end 114 of the protrusion 111 to form a loop. It is understood, however, that any number of shapes (e.g., rectangle, triangle, etc.) may be used to form the protrusion 111 as suits a particular purpose. In one aspect of the technology, the sidewalls 113 and distal end 114 have a notch 115 disposed therein. The notches 115 on the sidewalls 113 are configured to mate with tabs 142 and the notch 115 on the distal end 114 of the protrusion 111 is configured to facilitate drainage of fluid that may accumulate in the pass through opening 112 and the ground surface. The male coupling member 140 comprises a pair of parallel laterally flexible plates 141 extending downward from the top surface 101 of the modular floor tile 100. A side tab 142 is disposed on an outside surface of each of the pair of flexible plates 141. The tab 142 comprises a lip 143 configured to fit over a bottom edge 116 of the outwardly extending protrusion 111 when the male coupling member 140 is placed through the pass through opening 112 of a corresponding female coupling member 110 of an adjacent modular floor tile 100. A center plate 144 is disposed between the pair of flexible plates 141 and is configured to limit the inward lateral movement of the flexible plates 141 during placement of the male coupling member 140 into the female coupling member 110. That is, as the male member 140 is placed through the opening 112, the plates 141 are flexed together to facilitate passage of the member 140 through the pass through opening 112.

A space 145 is located between the flexible plates 141 to facilitate the inward lateral flexing of the plates 141 during placement of the male coupling member 140 into the female coupling member 110. The space 145 is also present between the flexible plates 141 and the center plate 144. An edge tab 146 extends downward from and outward from at least one of the plurality of edge surfaces 102 of the tile 100. The edge tab 146 has a first and second side surface 147, 148. A first one 141*a* of the pair of parallel flexible plates 141 has an outside surface 149 that is coplanar with the first side surface 147 of the edge tab 146 and a second one 141*b* of the pair of parallel flexible plates 141 has an outside surface 150 that is coplanar with a second side surface 148 of the edge tab 146.

While reference is made herein to parallel plates, in accordance with one aspect, the plates need not be parallel so long as they flex inwardly to accommodate placement within the pass through opening 112. Moreover, while the downward extending members are described as plates, other shapes may be used to accomplish the objective of lateral and vertical locking of adjacent tiles with a single locking mechanism. The dimension of the downward extending members limit lateral movement of adjacent tiles within the pass through opening and the tabs limit relative vertical movement. In one aspect, tabs may also be placed on the insides of plates (or downward extending members) to limit the inward flexing of the plates. Or the plates themselves may be shaped in a particular manner (e.g., opposing triangles with tips facing one another) that limit the inward flexing of the plate.

In accordance with one aspect, the pair of flexible plates 141 are not connected to the edge tab 146 and flex independently from the edge tab 146 and independently from one another. In one aspect of the technology, the edge tab 146 comprises a lip 151 that is configured to fit on a bottom side edge surface 108 of an adjacent tile 100. Similar to the flexing plates 141, the edge tab 146 is configured to flex during placement of the male coupling member 140 into the female coupling member 110 except that the edge tab 146 flexes in a direction that is normal to the flexing direction of the flexible plates 141. A front side 153 of the flexible plates 141 is disposed behind a back side of the edge tab 146 forming a space 154 between the back side of the flexible plates 141 and the edge tab 146.

In one aspect of the technology, the flexible plates 141 have a beveled back side 155. The center plate 144 has a rounded back side 156 that has a radius of curvature approximate to the radius of curvature of the loop of the protrusion 111 and is disposed behind the back side 155 of the flexible plates 141. The beveled back side 155 and rounded back side 156 together approximate the curvature of the loop of the protrusion 111. The flexible plates 141 have a length that is at least greater than one half the length of the side walls 113 of the protrusion 111 and, together with the center plate 144, are intended to approximate the shape of the protrusion 111. But for the space 145 between the center plate 144 and flexible plates 141, the combined center plate 144 and flexible plates 141 would substantially replicate the internal shape of the protrusion 111 to create a complimentary fit between the male coupling member 140 and female coupling member 110.

In accordance with one aspect of the technology, the outer dimensions of the male coupling member 140 are defined by a back side of the center plate 144, the outer edge of the lip 143 on tabs 142 disposed on the outer surface of the flexible plates 141, and the outer edge of the lip of the edge tab 146. The male coupling member 140 is sized such that the outer dimensions of the male coupling member 140 exceed the inner dimensions of the pass through opening 112 of the protrusion 111. The lips 143 on tabs 142 and the lip on edge tab 146 are beveled such that as the male coupling member 140 is placed downward through the protrusion 111, flexible plates 141 and the edge tab 146 flex inward until the outer edge of the lips of each of the respective tabs are within the inner perimeter of the protrusion 111. The edge tab 146 flexes in a direction that is normal to the flexing direction of flexing plates 141. Once within the inner perimeter of the protrusion 111, the male coupling member 140 is guided through the opening 112 until the lips of each of the respective tabs are below a bottom surface of the protrusion 111 (for lips 143 of tabs 142) or below a bottom side edge surface 102 of the tile 100. During placement through the pass through opening 112, the tabs are biased inward. Once through the pass through opening 112, the tabs move back to an unbiased state. In one aspect of the technology, the lips 143 of tabs 142 are configured to fit within the notches disposed about opposing sides of the protrusion 111. The flexing plate arrangement facilitates easier locking and unlocking of adjacent tiles together limiting both vertical and lateral movement.

In accordance with one aspect of the technology, the width of the flexible plates 141 ranges from 0.5 to 1.5 mm and a distance from outside surfaces 121*a* and 121*b* of the flexible plates 141 ranges from 7 to 10 mm. The width of the center plate 144 ranges from 1 to 3 mm and the width of the space 145 between the centerplate 144 and flexible plates 141 ranges from 1 to 4 mm. The outside surfaces 147 and 148 of edge tab 146 likewise range from 7 to 10 mm. A distance between the end of opposing tabs 142 ranges from 8 to 12 mm and a distance from the back end 156 of the center plate 144 and the front end of edge tab 146 ranges from 17 to 22 mm. The widths (as well as other dimensions provided herein) are non-limiting examples only. By varying the width of the flexible plates 141, the relative flexibility of the plates 141 is controlled as the surface area of the connection between the plates 141 and tile 100 is increased. This may be varied depending on the type of material used to construct the tile 100 and the desired resistance to movement. For example, the wider the flex plate 141, the less relative lateral flexibility it will have. Likewise, variations in the width of the center plate 144 will control the amount of lateral inward flex that the flexible plates 141 may experience. For example, if the center plate 144 occupies a majority of the space 145 between flexible plates 141, the lateral inward flex of the flexible plates 141 will be minimal. The center plate 144, however, may be removed and the flexible plates 141 permitted to flex inward without that limitation. The length of the flexible plates 141 and resulting space 154 between the end of the flexible plates 141 and the back side of edge tab 146 likewise may be varied to control the relative amount of backward flex in the edge tab 146. That is, the larger the space 154 between the front side of the flex plates 141 and back side of the edge tab 146, the larger the amount of available backward flex. The relative taper on the lips 143 of side tabs 142 and the lip 151 of the edge tab 146 as well as the size of the tabs themselves may also be varied to control the relative ease with which the male coupling member 140 fits within the female coupling member 110. Additionally, the taper on the back end of the flexible plates 141 and rounded portion 156 of the center plate 144 may be varied to approximate the shape of the distal end 114 of the protrusion 111. Many other variations of different dimensions may be made to the features described herein; the above variations are provided as non-limiting examples only.

Broadly speaking, a user may employ a method of connecting adjacent flooring components together comprising the steps of obtaining a first flooring component for placement upon on a ground surface wherein the first flooring component comprises a protrusion 111 extending outwardly from an edge surface 102 of the flooring component, said protrusion 111 having at least one pass through opening 112. A second flooring component is obtained for placement upon a ground surface wherein second flooring component comprises a pair of parallel laterally flexible plates 141 extending downward from the top surface 101 of the second flooring component, a tab 142 disposed on a bottom side surface of each of the pair of flexible plates 141, and a center plate 144 disposed between the pair of flexible plates 141. The user places the pair of parallel laterally flexible plates 141 through the pass through opening 112 of the protrusion 111 as the plates 141 flex inward toward one another, the center plate 144 being configured to limit the lateral inward flexing of the flexible plates 141. The flexing reduces the dimension of the flexible plates 141 so they will fit within the internal dimensions of the pass through opening 112. After passing through the opening 112, the user fits the tabs 142 of the laterally flexible plates 141 over a bottom edge 116 of the outwardly extending protrusion 111. In one aspect, the second flooring component comprises an edge tab 146 extending downward from at least one of the plurality of edge surfaces 102. The edge tab 146 flexes in a direction that is normal to the flexing direction of the pair of flexible plates 141. The method further comprises fitting the edge tab 146 underneath a side surface 108 of the first flooring component. In practice, a single flooring component will have both the protrusion 111 and the flexible plates 141 on a single component. The components will reside on different sides of the floor tile 100 so that a single style of tile 100 can be used to construct an entire floor by positioning the tiles 100 in different orientations with the different sides of tiles fitting into adjacent tiles.

With reference generally to FIGS. 22-25, in one aspect of the technology, a flooring component or modular flooring tile 200 is shown. The tile 200 comprises a top surface 201 and a plurality of side edge surfaces 202 defining a perimeter about the top surface 201. The top surface 201 has a plurality of intersecting rib members 203 defining apertures 204. However, it is understood that in certain aspects of the technology the top surface 201 may comprise a continuous surface with no apertures as suits a particular application. A support system, including a plurality of post structures 205 is disposed at least partially beneath the top surface 201. In one aspect of the technology, male and female coupling members 240 and 210 are disposed about the tile 200 and provide a locking system to couple adjacent tiles together. In accordance with one aspect of the technology, the female coupling member 210 comprises a protrusion 211 extending outward from a side edge 202 of the tile 200. The protrusion 211 comprises a pass through opening 212 and outer semi-rigid side walls 213 that couple to the side edge 202 of the tile 200. In one aspect of the technology, the outer semi-rigid side walls 213 of the protrusion 111 are joined together at a distal end 214 of the protrusion 211 to form a loop. It is understood, however, that any number of shapes (e.g., rectangle, triangle, etc.) may be used as suits a particular purpose. The protrusion 211 further comprises a flexible inner side wall 215 separated from the semi-rigid outer side wall 213 by apertures 216 to permit lateral flexing of the inner side wall 215. The term semi-rigid as used herein refers to a construction that is not intended to flex as part of its normal operation. The outer sidewalls 213 of this aspect may be constructed of a synthetic polymer and hence may yield to an applied pressure, but they will typically not yield to pressure without suffering some plastic deformation. The term flexible as used herein refers to a construction that permits the referenced component to flex or move in one or more directions without suffering from plastic deformation. In one aspect of the technology, the protrusion 211 has a cut-way 217 disposed about the distal end 214. This cut-away 217 portion facilitates drainage of fluid that may otherwise accumulate within the pass through opening 212 of the protrusion 211.

In one aspect of the technology, the inner side wall 215 is coupled to the tile 200 at side walls 202 and is coupled to the outer side wall 213 near a distal end 214 of the protrusion 211, though the inner side wall 215 may couple to the outer side wall 213 at any number of locations as suits a particular design. A second protrusion 220 extends downward from the top surface 201 of the tile 200 and is configured to be disposed through the pass through opening 212 of the protrusion 211 within the inner flexible sidewalls 215. The downward protrusion 220 comprises a plurality of walls 221 that form a U-shape, though other shapes (e.g., rectangular, triangular, curvilinear, etc.) may be used. An outwardly extending side tab 222 is disposed on the ends of each of the opposing walls 221 of the second protrusion 220, said side tabs 222 have a bottom lip 223 configured to fit over a bottom edge of the flexible inner sidewalls 215 of the first protrusion 211 of an adjacent modular floor tile 100. The side tabs 222 extend in a direction parallel to the flexing direction 217 of the flexible sidewalls 215 of the first protrusion 211. In one aspect of the technology, the walls 221 of the second protrusion 220 are semi-rigid walls. An outer perimeter of the walls 221 of the second protrusion 220 are shaped to approximate an inner perimeter of the flexible sidewalls 215 of the first protrusion 211 (e.g., U-shaped, rectangular, triangular, or otherwise). The flexible inner sidewalls 215 together with the downward protrusion 220 improve the user's capacity to more easily lock adjoining tiles 200 together.

In another aspect of the technology, the tile 200 further comprises an edge tab 230 that extends downward from and laterally outward from at least one of the plurality of edge surfaces 202 of the tile 200. The edge tab 230 flexes in a direction that is normal to the flexing direction of the pair of flexible sidewalls 215 of the first protrusion 211. The edge tab 230 has first and second side surfaces 231, 232. A first one 221*a* of the pair of opposing walls 221 of the second protrusion 220 has an outside surface that is coplanar with the first side surface 231 of the edge tab 230 and a second one 221*b* of the pair of opposing walls 221 of the second protrusion 220 has an outside surface that is coplanar with a second side surface 232 of the edge tab 230. The second protrusion 220 is sized such that distance from the back side 226 of the protrusion 220 to the front side 234 of the edge tab 230 is longer than the longitudinal distance of the pass through opening 212 within the inner flexible side walls 215. Likewise, the second protrusion 220 is sized such that the distance from the outside edges of opposing side tabs 222 is greater than the width of the pass through opening 212 within the inner flexible side walls 215. A top surface of the edge tab 230 and the side tabs 222 have a tapered surface. In this manner, as the second or downward facing protrusion 220 is placed within the opening 212 of the first protrusion 211, the edge tab 230 flexes inward and the flexible inner side walls 215 flex outward until the inner dimensions of the flexible inner side walls 215 and the outer dimension of the second or downward facing protrusion 220 are modified (i.e., placed in a biased state) to permit passage of the second protrusion 220 through the pass through opening 212 of the protrusion 211. After passing through the pass through opening 212, the edge tab 230 and the inner side walls 215 return to their original or unbiased condition. In that state, the lips 235 of the edge tab 230 fit beneath a bottom side edge 208 of the tile 200 and lips 227 of side tabs 222 fit beneath a bottom of the inner side walls 215.

In accordance with one aspect of the technology, the semi-rigid outer walls 213 have a width varying from 2 to 4 mm and the width of the flexible inner walls 215 vary from 0.5 to 2 mm. The space or aperture 216 between the outer wall 213 and flexible inner wall 215 varies from 0.5 to 4 mm. As with other dimensions provided herein, these dimensions are non-limiting examples and may be varied as suits a particular design application. For example, the width of the flexible inner walls 215 may be varied to control the relative resistance to movement. In a scenario where the male coupling member 240 has a rigid, semi-rigid or flexible construction (see, e.g., the flexible plate arrangement of coupling member 140), the flexibility of the inner wall 215 may be increased to emphasize flexing of the female coupling member 210 (i.e., less flexing from the male member 240) or may be decreased to emphasize flexing of the male coupling member 240.

Figure 25:
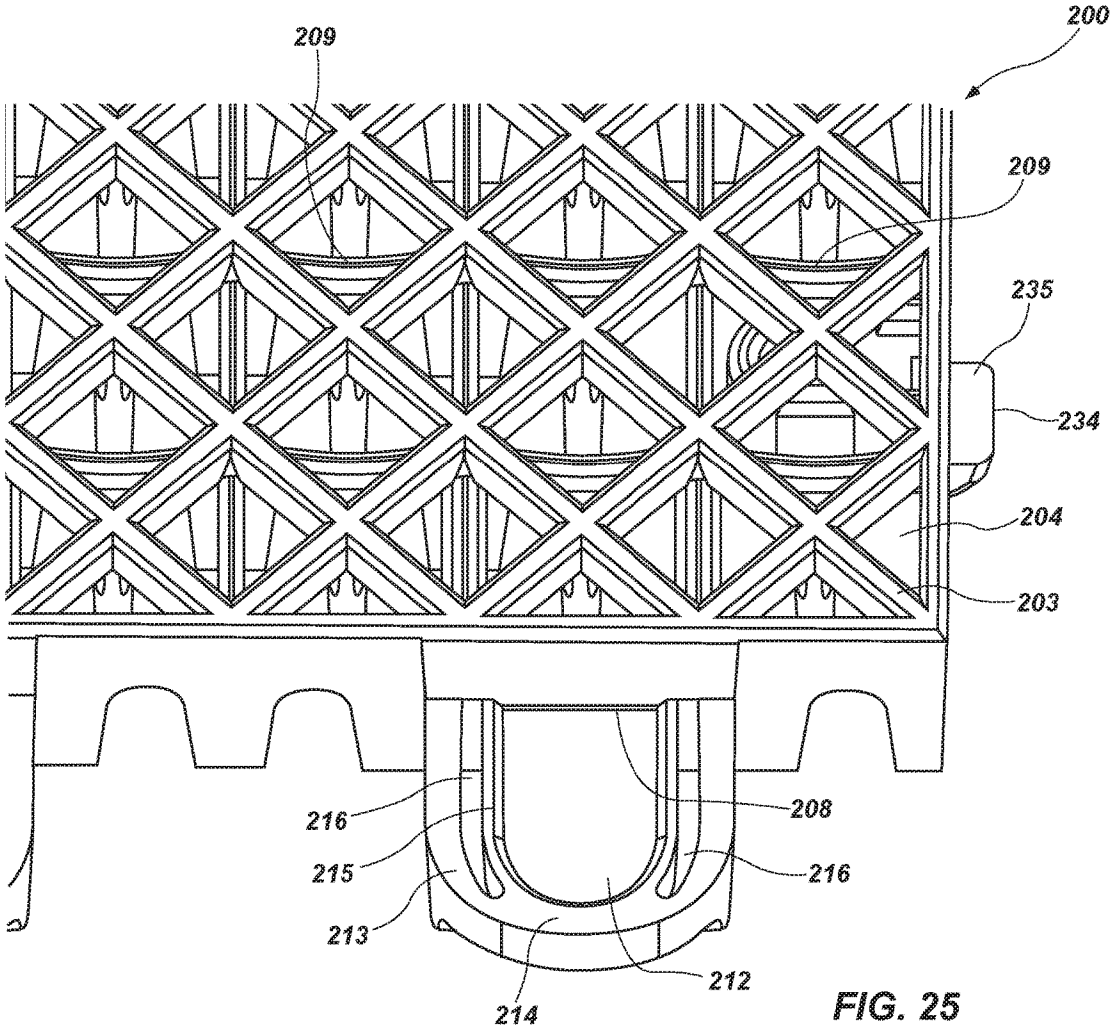
FIG. 25 is a top perspective view of a portion of the floor tile of FIG. 22.
Figure 26:
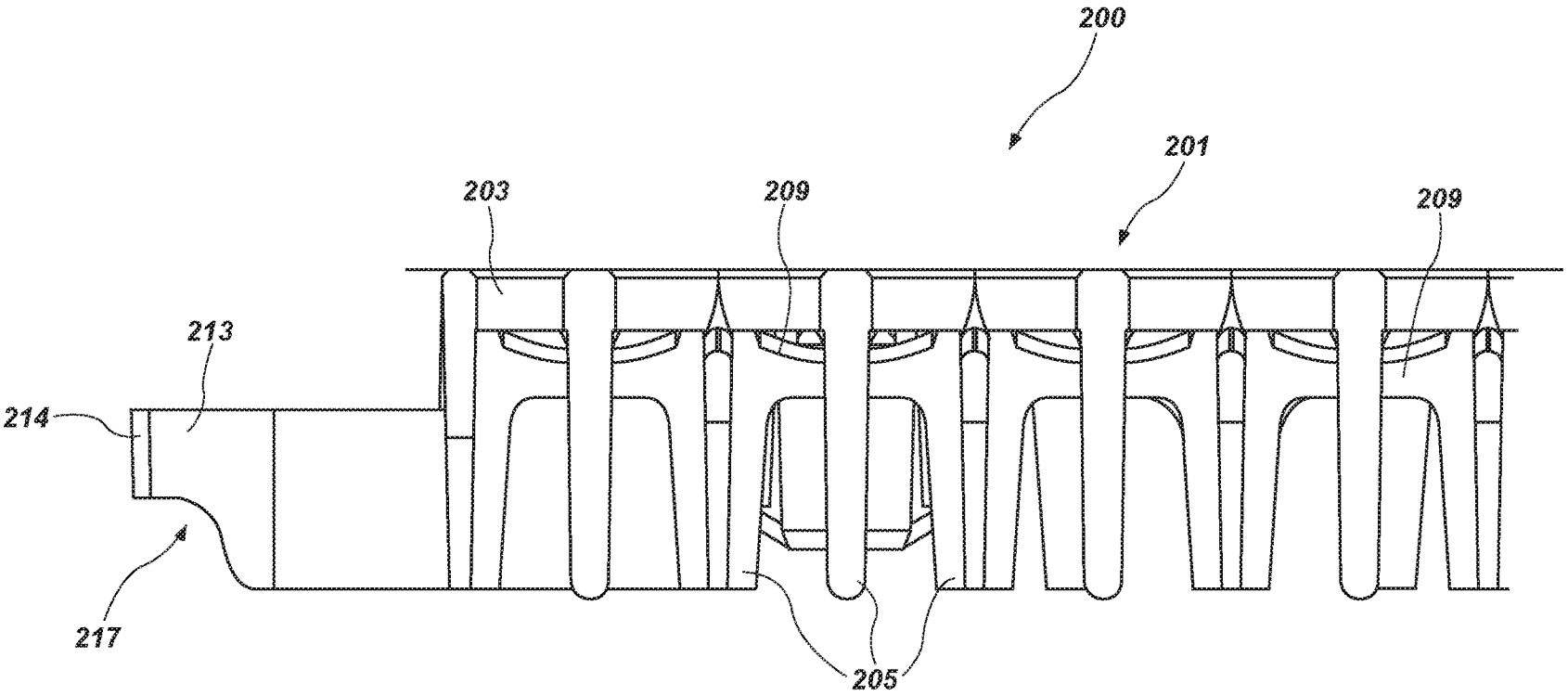
FIG. 26 is a cross-sectional side view of a portion of the floor tile of FIG. 22.

With reference generally to FIGS. 25 and 26, in accordance with one aspect of the technology, the top surface 201 of the tile 200 comprises a plurality of interconnected rib members 203 defining plurality of apertures 204 in the top surface 201. The top surface 201 is supported above the ground surface by a support system comprising support posts 205 that, in one aspect, are interconnected by additional rib members 209 disposed beneath the upper rib members 203. The upper rib members 203 form the contact surface on which a user treads. The lower rib members 209 are disposed beneath the upper rib members 203 and traverse the aperture 204 defined by the upper rib members 203. The lower rib members 209 form a downward trending curvilinear or saddle shape beneath the aperture 204. In an instance where a lower rib member 209 has an upper surface that is flat and coplanar with a bottom surface of upper rib members 203, water has a tendency to become entrained within the aperture 204. The curvilinear or saddle shape of the lower rib 209 advantageously improves water drainage through the apertures 204. It also facilitates a decrease in occlusion of the aperture 204 by other matter (i.e., dirt, leaves, etc.) that may otherwise become entrained in the aperture 204. In one aspect, the lower rib member 209 has a top surface that is rounded or triangular to facilitate passage of water or other materials over the lower rib 209.

In accordance with one aspect of the technology, a method of connecting adjacent flooring components together is disclosed. The method comprises the steps of obtaining a first flooring component for placement upon on a ground surface, said first flooring component comprising a protrusion extending outwardly from an edge surface of the flooring component, said protrusion having at least one pass through opening defined by a pair of flexible sidewalls. The method further comprises obtaining a second flooring component for placement upon a ground surface, said second flooring component comprising a protrusion extending downward from the top surface comprising a pair of opposing walls and an outwardly extending tab disposed on the ends of each of the opposing walls. The downward extending protrusion is mated with the laterally extending protrusion of adjacently placed flooring components as the inner sidewalls are flexed in a direction parallel with a length of the outwardly extending tab by placing the downwardly extending protrusion through the pass through opening. A bottom surface of the outwardly extending tabs are fit beneath a surface of the flexible inner sidewalls.

The foregoing detailed description describes the technology with reference to specific exemplary aspects. However, it will be appreciated that various modifications and changes can be made without departing from the scope of the present technology as set forth in the appended claims. The detailed description and accompanying drawings are to be regarded as merely illustrative, rather than as restrictive, and all such modifications, combination of features, or changes, if any, are intended to fall within the scope of the present technology as described and set forth herein. In addition, while specific features are shown or described as used in connection with particular aspects of the technology, it is understood that different features may be combined and used with different aspects. By way of example only, the flexible plates 141 of one aspect may be used in connection with the flexible side walls 215 of another aspect of the technology. Likewise, numerous features from various aspects of the technology described herein may be combined in any number of variations as suits a particular purpose.

More specifically, while illustrative exemplary aspects of the technology have been described herein, the present technology is not limited to these aspects, but includes any and all aspects having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the technology should be determined solely by the appended claims and their legal equivalents, rather than by the descriptions and examples given above.

The invention claimed is:

1. A modular floor tile comprising:

a top surface;

a plurality of edge surfaces defining a perimeter about the top surface;

a locking system comprising:

(i) a protrusion extending outwardly from at least one of the plurality of edge surfaces, said protrusion having at least one pass through opening;

(ii) a pair of laterally flexible plates extending downward from the top surface of the modular floor tile and configured to be disposed within the at least one pass through opening of the outwardly extending protrusion of an adjacent modular floor tile, wherein the pair of laterally flexible plates are not connected to one another; and (iii) a tab disposed on a side surface of each of the pair of flexible plates, said tab configured to fit over a bottom edge of the outwardly extending protrusion of an adjacent modular floor tile.

2. The modular tile of claim 1, wherein the locking system comprises a center plate disposed between the pair of flexible plates, said center plate configured to limit lateral inward movement of the flexible plates.

3. The modular tile of claim 2, further comprising a concave rib, wherein a bottom of the concave rib is disposed beneath an aperture formed in the top surface of the tile.

4. The modular tile of claim 1, wherein the locking system further comprises an edge tab extending downward from and extending outward from at least one of the plurality of edge surfaces, the edge tab having first and second side surfaces, wherein a first one of the pair of parallel flexible plates has an outside surface that is coplanar with the first side surface of the edge tab and a second one of the pair of parallel flexible plates has an outside surface that is coplanar with a second side surface of the edge tab.

5. The modular tile of claim 4, wherein the pair of flexible plates are not connected to the edge tab and flex independently from the edge tab and independently from one another.

6. The modular tile of claim 1, wherein the protrusion comprises a notch disposed about opposing sides of the protrusion.

7. The modular tile of claim 6, wherein the tabs disposed about the flexible plates are configured to fit within the notches disposed about opposing sides of the protrusion.

8. The modular tile of claim 1, wherein the flexible plates have a beveled back side and wherein a back side of a center plate is disposed behind the back side of the flexible plates.

9. A modular flooring system, comprising:

at least two adjacent flooring tiles positioned adjacent one another, each flooring tile comprising:

a top surface comprising a plurality of rib members;

an edge surface defining a perimeter about the floor tile;

a locking system comprising:

(i) a protrusion extending outwardly from at least one of the plurality of edge surfaces, said protrusion having at least one pass through opening;

(ii) a pair of parallel laterally flexible plates extending downward from the top surface of the modular floor tile disposed within the at least one pass through opening of the outwardly extending protrusion of an adjacent modular floor tile;

(iii) a tab disposed on a side surface of each of the pair of flexible plates, wherein said tab is placed over a bottom edge of the outwardly extending protrusion of an adjacent modular floor tile; and (iv) a center plate disposed between the pair of flexible plates, said center plate configured to limit inward lateral movement of the flexible plates.

10. The system of claim 9, wherein the locking system further comprises an edge tab extending downward from and extending outward from at least one of the plurality of edge surfaces, the edge tab flexing in a direction that is normal to the flexing direction of the pair of flexible plates.

11. The system of claim 10, wherein the edge tab has first and second side surfaces, wherein a first one of the pair of parallel flexible plates has an outside surface that is coplanar with the first side surface of the edge tab and a second one of the pair of parallel flexible plates has an outside surface that is coplanar with a second side surface of the edge tab.

12. The system of claim 9, wherein the protrusion comprises a notch disposed about opposing sides of the protrusion and wherein the tabs disposed about the flexible plates are configured to fit within the notches disposed about opposing sides of the protrusion.

13. The system of claim 9, wherein each of the flexible plates has a length that is greater than one half a length of the outwardly extending protrusion.

14. A modular flooring system, comprising:

first and second floor tiles positioned adjacent one another, each flooring tile comprising:

a top surface;

an edge surface defining a perimeter about the floor tile;

a locking system comprising:

(i) a protrusion extending outwardly from at least one of the plurality of edge surfaces, said protrusion having at least one pass through opening defined by parallel sides and an end coupling the parallel sides together;

(ii) a pair of laterally flexible plates extending from the top surface of the modular floor tile, the laterally flexible plates disposed within the at least one pass through opening of the outwardly extending protrusion of an adjacent modular floor tile; and (iii) a center plate disposed between the pair of flexible plates, wherein an end of each of the flexible plates contacts a portion of the center plate during placement of the flexible plates within the pass through opening of the protrusion.

15. The modular flooring system of claim 14, wherein the flexible plates are fixed to a bottom of the top surface of the modular floor tile.

16. The modular flooring system of claim 14, wherein the protrusion comprises a plurality of pass through openings.

17. The modular flooring system of claim 16, wherein a sidewall of the protrusion is flexible.

18. The modular flooring system of claim 14, wherein the center plate has a height that is equivalent to a height of the flexible plates.

19. The modular flooring system of claim 14, wherein the center plate has a length that is less than a length of the flexible plates.

* * * * *